US007029140B2

(12) United States Patent
Wong et al.

(10) Patent No.: US 7,029,140 B2
(45) Date of Patent: Apr. 18, 2006

(54) FLASHING LIGHT SYSTEM WITH MULTIPLE VOLTAGES

(75) Inventors: Wai Kai Wong, Hong Kong (CN); Lai Cheong Mak, Hong Kong (CN)

(73) Assignee: Cheerine Development (Hong Kong) Ltd., Kowloon (HK)

( * ) Notice: Subject to any disclaimer, the term of this patent is extended or adjusted under 35 U.S.C. 154(b) by 103 days.

(21) Appl. No.: 10/744,267

(22) Filed: Dec. 23, 2003

(65) Prior Publication Data

US 2005/0134191 A1 Jun. 23, 2005

(51) Int. Cl.
*F21V 21/08* (2006.01)

(52) U.S. Cl. ..... 362/103; 362/227; 362/800; 362/802; 315/200 A; 315/160; 315/360

(58) Field of Classification Search ..... 315/160, 315/209 R, 312, 200 A, 360, 362; 362/800, 362/802, 103, 227
See application file for complete search history.

(56) References Cited

U.S. PATENT DOCUMENTS

| | | | | |
|---|---|---|---|---|
| 1,597,823 | A | | 8/1926 | Randolph |
| 1,933,243 | A | | 10/1933 | De Merolis et al. |
| 2,572,760 | A | | 10/1951 | Rikelman |
| 2,634,407 | A | | 4/1953 | Johnson |
| 2,671,209 | A | | 3/1954 | Habib |
| 2,671,847 | A | | 3/1954 | Lerch |
| 2,816,284 | A | | 12/1957 | Campanell |
| 2,849,819 | A | | 9/1958 | Murphy et al. |
| 2,931,893 | A | | 4/1960 | Gonzalez Arias et al. |
| 2,959,892 | A | | 11/1960 | Johnson |
| 2,976,622 | A | | 3/1961 | Shearhouse |
| 3,008,038 | A | | 11/1961 | Dickens et al. |
| 3,053,949 | A | | 9/1962 | Johnson |
| 3,070,907 | A | | 1/1963 | Rocco |
| 3,564,232 | A | | 2/1971 | Ellerbe et al. |
| 3,731,022 | A | * | 5/1973 | Loftus ..... 200/61.49 |
| 3,800,133 | A | | 3/1974 | Duval |
| 3,893,247 | A | | 7/1975 | Dana, III |
| 3,946,505 | A | | 3/1976 | Dana, III |
| 3,968,641 | A | | 7/1976 | Moyer |

(Continued)

FOREIGN PATENT DOCUMENTS

EP 0 121 026 A1 10/1984

(Continued)

OTHER PUBLICATIONS

Combined Search and Examination Report, dated Dec. 17, 2003, for corresponding United Kingdom application No. GB 0315369.9.

*Primary Examiner*—Shih-Chao Chen
*Assistant Examiner*—Leith A. Al-Nazer
(74) *Attorney, Agent, or Firm*—Brinks Hofer Gilson & Lione

(57) ABSTRACT

Flashing lights may be added to footwear or other objects worn by persons. Flashing light systems are necessarily compact, consisting primarily of flashing lights and a power-and-control circuit that controls and enables the flashing of the lights. The lights may be illuminated by differing voltage levels, so that lights will flash brighter or dimmer depending on whether the light receives a higher voltage or a lower voltage. The voltages may be achieved by using batteries in series. A unique flashing effect is achieved by the use of differing voltages in sequence on the same lamps or LEDs. A battery charger may also be included to restore battery life.

27 Claims, 20 Drawing Sheets

U.S. PATENT DOCUMENTS 4,009,387 A 2/1977 Nuver
4,014,115 A 3/1977 Reichert
4,020,572 A 5/1977 Chiaramonte, Jr.
4,128,861 A 12/1978 Pelengaris
4,130,951 A 12/1978 Powell
4,158,922 A 6/1979 Dana, III
4,231,079 A * 10/1980 Heminover ..... 362/106
4,253,253 A 3/1981 McCormick
4,258,991 A * 3/1981 Kuraishi ..... 396/203
4,298,917 A 11/1981 Ware
4,350,853 A 9/1982 Ganyard
4,367,515 A 1/1983 Beard
4,412,205 A * 10/1983 Von Kemenczky ..... 340/331
4,459,645 A 7/1984 Glatter
4,588,387 A 5/1986 Swenson
4,701,146 A 10/1987 Swenson
4,800,469 A 1/1989 Leon
4,848,009 A * 7/1989 Rodgers ..... 36/137
4,870,325 A 9/1989 Kazar
4,897,947 A 2/1990 Kass-Pious
4,995,294 A 2/1991 Kashio et al.
5,016,144 A 5/1991 DiMaggio
5,027,035 A 6/1991 McGrail et al.
5,033,212 A 7/1991 Evanyk
5,052,131 A 10/1991 Rondini
5,099,192 A 3/1992 Thayer et al.
5,188,447 A 2/1993 Chiang et al.
5,285,586 A 2/1994 Goldston et al.
5,303,131 A 4/1994 Wu
5,303,485 A 4/1994 Goldston et al.
5,313,187 A 5/1994 Choi et al.
5,343,190 A 8/1994 Rodgers
5,353,441 A 10/1994 Lazorchak
5,357,697 A 10/1994 Lin
5,371,662 A 12/1994 Shen-Ko
5,381,615 A 1/1995 MacMillan
5,396,720 A 3/1995 Hwang et al.
5,400,232 A 3/1995 Wong
5,406,724 A 4/1995 Lin
5,408,764 A 4/1995 Wut
5,419,061 A 5/1995 Barrocas
5,422,628 A 6/1995 Rodgers
5,438,488 A 8/1995 Dion
5,438,493 A 8/1995 Tseng
5,455,749 A 10/1995 Ferber
5,456,032 A 10/1995 Matsumoto et al.
5,457,900 A 10/1995 Roy
5,461,188 A 10/1995 Drago et al.
5,463,537 A 10/1995 Trattner et al.
5,465,197 A 11/1995 Chien
5,477,437 A 12/1995 Lach
5,483,759 A 1/1996 Silverman
5,485,358 A 1/1996 Chien
5,490,338 A 2/1996 Hwang et al.
5,495,136 A 2/1996 Chiang et al.
5,495,682 A 3/1996 Chen
5,500,635 A 3/1996 Mott
5,508,899 A 4/1996 McCormick
5,516,149 A 5/1996 Moore
5,546,681 A 8/1996 Goldston et al.
5,550,721 A 8/1996 Rapisarda
5,566,479 A 10/1996 Gray et al.
5,577,828 A 11/1996 Nadel et al.
5,599,088 A 2/1997 Chien
5,604,999 A 2/1997 Barker
5,644,858 A * 7/1997 Bemis ..... 36/137
5,653,523 A 8/1997 Roberts
5,663,614 A 9/1997 Weng et al.
5,683,164 A 11/1997 Chien
5,730,520 A 3/1998 Hsu et al.
5,732,486 A 3/1998 Rapisarda
5,746,499 A 5/1998 Ratcliffe et al.
5,754,064 A 5/1998 Chien
5,758,946 A 6/1998 Chen
5,812,063 A 9/1998 Weng et al.
5,821,858 A 10/1998 Stone
5,839,814 A 11/1998 Roberts
5,844,377 A 12/1998 Anderson et al.
5,855,382 A 1/1999 Reilly et al.
5,894,201 A 4/1999 Wong
5,903,103 A 5/1999 Garner
5,945,911 A 8/1999 Healy et al.
5,957,541 A 9/1999 Seigler
5,969,479 A 10/1999 Wong
6,012,822 A 1/2000 Robinson
6,094,141 A * 7/2000 Tsai ..... 340/573.1
6,145,999 A 11/2000 Van Derlande
6,164,794 A 12/2000 Rodgers
6,170,968 B1 1/2001 Caswell
RE37,220 E 6/2001 Rapisarda et al.
6,241,371 B1 6/2001 Dai
6,246,186 B1 6/2001 Nieberger
6,280,045 B1 8/2001 Anteby et al.
6,348,766 B1 2/2002 Ohishi et al.
6,354,712 B1 3/2002 Anteby
6,360,615 B1 3/2002 Smela
6,408,545 B1 6/2002 Song
6,525,487 B1 * 2/2003 Wei ..... 315/200 A
6,619,812 B1 9/2003 Rapisarda
6,776,498 B1 * 8/2004 Yeung ..... 362/103
6,802,755 B1 * 10/2004 Walker et al. ..... 446/175
6,836,751 B1 * 12/2004 Paxton et al. ..... 702/186
2003/0137852 A1 7/2003 Rapisarda
2004/0160196 A1 * 8/2004 Wong ..... 315/291

FOREIGN PATENT DOCUMENTS

EP 0 335 467 B1 6/1993
GB 2 144 000 A * 2/1985
JP 54-133766 10/1979
JP 354133766 A 10/1979
JP 355080376 A 6/1980
JP 40502118 A 1/1993
WO WO 93/11681 6/1993

* cited by examiner

LOGIC

| PIN | 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| INITIAL | 0 | 1 | 0 | 0 | 1 | 1 | 0 | 1 | 1 | 0 | 1 | 0 | 0 | 1 |
| ROW1 | 0 | 1 | 0 | 1 | 0 | 0 | 0 | 0 | 0 | 1 | 0 | 1 | 0 | 1 |
| ROW2 | 0 | 1 | 0 | 0 | 1 | 1 | 0 | 1 | 1 | 0 | 1 | 0 | 0 | 1 |
| ROW3 | 0 | 0 | 1 | 0 | 1 | 1 | 0 | 0 | 0 | 1 | 0 | 0 | 1 | 1 |
| ROW4 | 0 | 1 | 0 | 0 | 1 | 1 | 0 | 1 | 1 | 0 | 1 | 0 | 0 | 1 |
| ROW5 | 0 | 0 | 1 | 0 | 1 | 1 | 0 | 0 | 0 | 1 | 0 | 0 | 1 | 1 |
| ROW6 | 0 | 1 | 0 | 0 | 1 | 1 | 0 | 1 | 1 | 0 | 1 | 0 | 0 | 1 |

DECADE COUNTER

| 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|
| 0 | 0 | 1 | 0 | 0 | 0 | 1 | 0 | 0 | 0 | 0 | 0 | 0 | 1 | 0 | 1 |
| 0 | 0 | 1 | 0 | 0 | 0 | 1 | 0 | 0 | 0 | 0 | 0 | 0 | 0 | 0 | 1 |
| 0 | 0 | 1 | 0 | 0 | 0 | 1 | 0 | 0 | 0 | 0 | 0 | 0 | 1 | 0 | 1 |
| 0 | 1 | 0 | 0 | 0 | 0 | 0 | 0 | 0 | 0 | 0 | 0 | 0 | 0 | 0 | 1 |
| 0 | 1 | 0 | 0 | 0 | 0 | 0 | 0 | 0 | 0 | 0 | 0 | 0 | 1 | 0 | 1 |
| 0 | 0 | 0 | 1 | 0 | 0 | 0 | 0 | 0 | 0 | 0 | 0 | 0 | 0 | 0 | 1 |
| 0 | 0 | 0 | 1 | 0 | 0 | 0 | 0 | 0 | 0 | 0 | 0 | 0 | 1 | 0 | 1 |

FIG. 8

FLASHING LIGHT SYSTEM WITH MULTIPLE VOLTAGES

FIELD OF THE INVENTION

The present invention relates generally to flashing light systems for shoes and other footwear. More particularly, the flashing lights systems may use more than one voltage source and more than one voltage to vary the brightness of the flashing lights.

BACKGROUND OF THE INVENTION

Lighting systems have been incorporated into footwear, generating distinctive flashing of lights for persons wearing and seeing the footwear. These systems generally have an inertia switch, so that when a runner's heel strikes the pavement, the switch moves in one direction or another, triggering a response by at least one circuit that typically includes a power source and a means for powering and controlling the lights. The resulting light flashes are useful in identifying the runner, or at least the presence of a runner, because of the easy-to-see nature of the flashing lights. Thus, the systems may contribute to the fun of exercising while adding a safety feature as well. Prior art systems include those described in U.S. Pats. No. 5,894,201 and 5,969,479, which are hereby incorporated by reference in their entirety.

Flashing light systems may also be used in other shoes or footwear, for instance, for wearing at gatherings or parties. The flashing of lights adds a fun aspect to persons wearing the shoes and also for persons seeing the shoes. One deficiency is that prior art systems with batteries run down after a certain number of uses, and the lights no longer illuminate or flash. Thus, a user has only a limited amount of time or a limited number of uses before the lights will no longer illuminate.

Another deficiency is the limited voltage available to light lamps or LEDs used in flashing light systems. Some LEDs are designed to operate at a certain voltage, while others are designed to operate at higher voltages. In present systems, the lights are powered by a power supply at a single voltage. Thus, only one voltage is available for the LEDs. It would be desirable to be able to provide more than one voltage to lamps or LEDs in such a flashing light system. The present invention is directed at correcting this deficiency in the prior art.

SUMMARY

One embodiment of the invention is a flashing light system comprising a controller, an inertia switch connected to the controller, and a first power source connected to the controller. There is also a second power source connected in series to the first power source, at least one light source connected with the controller to receiver power from the first power source, and at least one light source connected with the controller to receive power from the first and second power sources.

Another embodiment is a flashing light system. The flashing light system comprises a controller, an inertia switch connected to the controller, and a first power source connected to the controller, and a second power source connected in series to the first power source. There is also a low-voltage light source connected with the controller to receive power from the first power source, and a medium voltage or a high-voltage light source connected with the controller to receive power from the first and second power sources.

Another embodiment is a flashing light system for footwear, the system comprising a first power source connected to supply power to at least a first light source, and a second power source connected in series with the first power source to supply power to at least one second light source. There is also a controller configured to receive power from at least one of the power sources, and at least one inertia switch connected to the controller, wherein the switch and the controller are configured to control application of power from the power sources to the light sources.

Another embodiment is a method for illuminating footwear with a flashing light system. The method comprises connecting a first voltage source to at least one first light source, and connecting a second voltage source to at least one second light source. The method also comprises illuminating the at least one first light source, illuminating the at least one second light source, and controlling a timing and at least two patterns of illumination of the light sources with an inertia switch. Another embodiment is a method of making a flashing light system. The method comprises connecting an inertia switch to a controller, connecting the controller to at least two light sources, connecting a first power source to the controller and at least one of the light sources, and connecting a second power source to at least one of the light sources.

Other systems, methods, features, and advantages of the invention will be or will become apparent to one skilled in the art upon examination of the following figures and detailed description. All such additional systems, methods, features, and advantages are intended to be included within this description, within the scope of the invention, and protected by the accompanying claims.

BRIEF DESCRIPTION OF THE FIGURES

The invention may be better understood with reference to the following figures and detailed description. The components in the figures are not necessarily to scale, emphasis being placed upon illustrating the principles of the invention. Moreover, like reference numerals in the figures designate corresponding parts throughout the different views.

FIG. 8 depicts a truth table for logical operation of a flashing light circuit according to the present invention.

DETAILED DESCRIPTION OF THE PRESENTLY PREFERRED EMBODIMENTS

Figure 1:
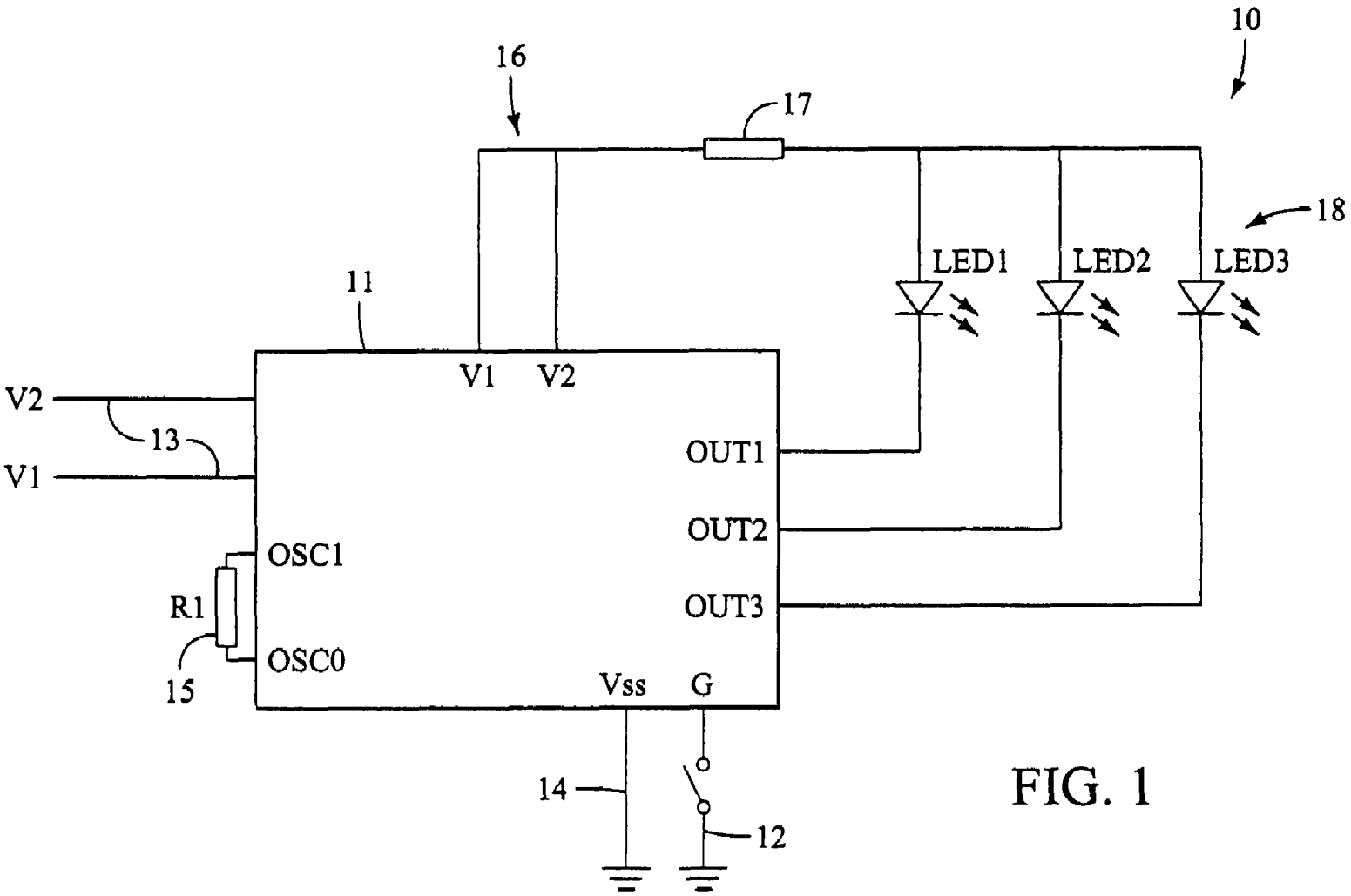
FIG. 1 is a block diagram of a first embodiment according to the present invention of a circuit for flashing LEDs.

Lighting or illumination systems for decoration or safety on clothing and personal articles must necessarily be compact and light-weight, so that the article to be illuminated can be easily adapted to receive and hold the illumination system. FIG. 1 represents a block diagram of such a system. An illumination system 10 comprises a controller 11, a switch 12, at least two voltage sources 13, a path to ground 14 and an oscillator resistor 15 for controlling the oscillation frequency. The voltages are connected to inputs of the controller 11 and to outputs 16 of the controller, V1 and V2. The outputs are intended to apply one voltage at a time through output resistor 17 to flashing lights 18, which may be LEDs or which may be other lamps. The switch may be an inertia switch, or may also be a touch switch or an on/off toggle switch, or any other suitable switch, such as a reed switch. In addition to a switch to begin flashing lights, there may be another switch to select one of several flashing sequences which may be stored in controller 11 or in other embodiments, may be stored in the memory of the controller or other component. Switch 12 notifies the controller to begin a sequence of flashing lights that is controlled by one or more patterns or routines that are programmed and stored in the controller. In this system, the voltages 13 may be any suitable voltages for the lamps or LEDs used, such as 1.5V to 6V or even higher voltages, from one or more batteries. The controller 11 routes one voltage at a time through current limiting resistor 17 to the LEDs 18. The circuit is completed when the controller closes circuits with pins OUT1, OUT2, or OUT3 in a predetermined pattern, such as a sequential flashing pattern, or other visually-interesting pattern. The LEDs may be any color that is commercially available, and should be rated in the range of about 1.5V to about 12V, the range of the power supplies or batteries available.

In this embodiment, outputs 16 may be either V1 or V2, which are different voltages, and thus different voltages are applied at different times to LEDs 18. When a greater voltage is applied, such as 4.5V, the LEDs will shine brightly. The voltages are applied through internal switching of the controller, which may be an integrated circuit or may be a custom-made or tailor-made circuit (application specific circuit) with internal gates for applying one voltage at a time from an input 13 to an output 16 using an internal gate for each voltage, such as V1 and V2. The controller completes the circuit and lights a lamp or an LED through OUT1, OUT2, or OUT3. When a lower voltage is applied such as 3V, the LEDs will shine less brightly. The LEDs may be any colors commercially available, such as red, green, blue, yellow, amber, white, purple, pink, orange, and so forth.

Controller 11 may be a custom-made oscillator-type integrated circuit, preferably in complementary MOS (CMOS) circuitry, made by a number of manufacturers, or the controller may be a different type of controller. Controller 203 may be an integrated circuit, such as MC14017BCP, CD4107AF, made by many manufacturers, or may be a custom or application specific integrated circuit, or may be a CMOS circuit. Other examples include M1320 and M1389 RC integrated circuits are made by MOSdesign Semiconductor Corp., Taipei, Taiwan. Another example is a controller made with CMOS technology, such as model EM78P153S, made by EMC Corp., Taipei, Taiwan. Any of these controllers, or other suitable controllers, may also be used in the embodiments of the present invention.

Figure 2:
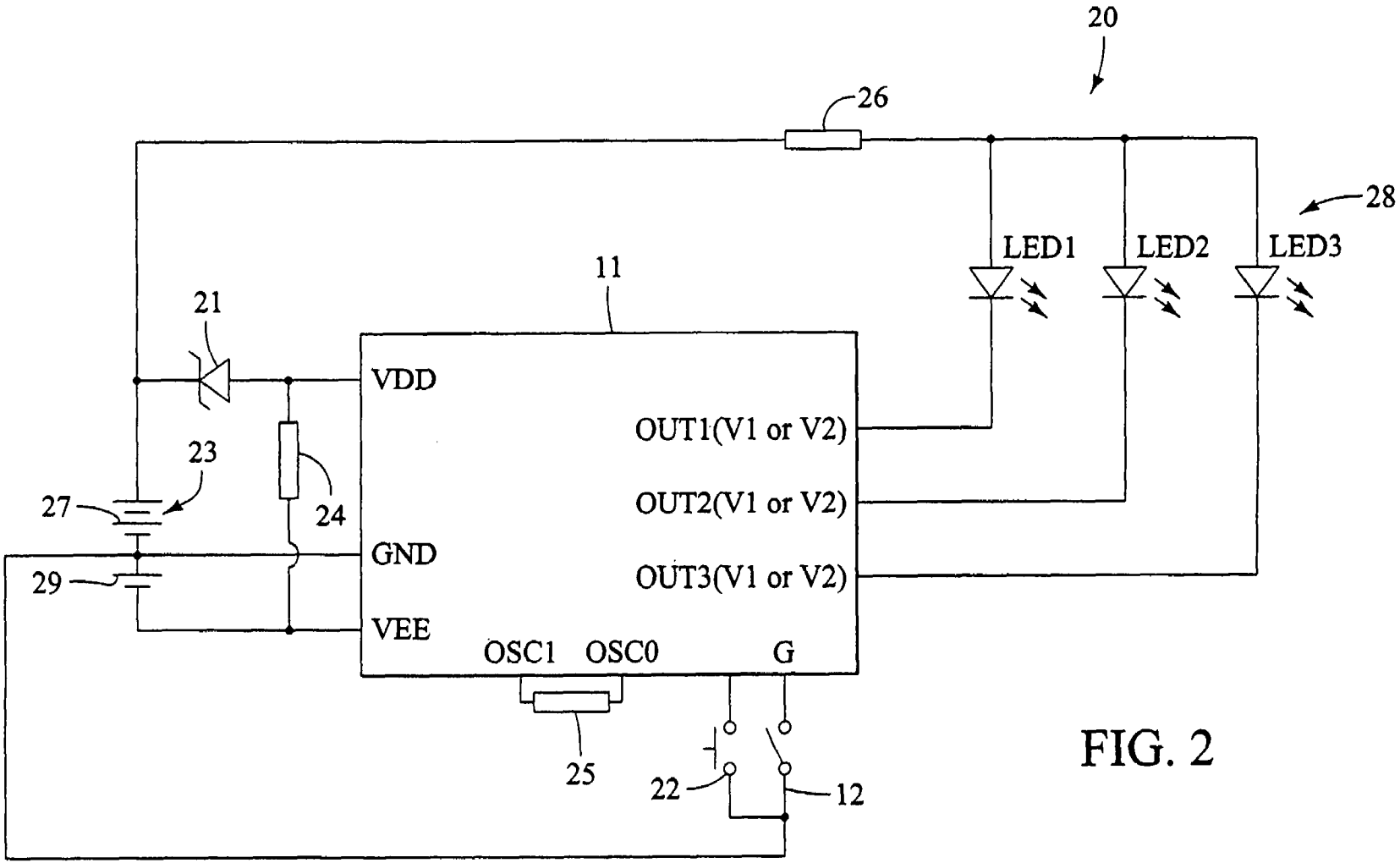
FIG. 2 is a block diagram of a second embodiment according to the present invention of a circuit for flashing LEDs.

Another embodiment of a flashing light circuit with a power selection feature is depicted in FIG. 2. In this embodiment, flashing light system 20 includes one or more batteries connected in series. Flashing light system 20 includes a controller 11, which may be the same type oscillator controller as in FIG. 1, or may be a different controller. There is an optional on/off or toggle switch 12 and a second switch 22, such as an inertia switch, touch switch or reed switch, but not limited to these switch embodiments, connected to the integrated circuit or controller 11. The controller has a resistor 25 to control the speed of the circuit. A power source 23 is made of two batteries, 27, 29 connected in series, such as a 3V battery and a 1.5V battery, or two 3V batteries. Combinations may include CR2032, L1154, AAA, AA, C or D size batteries, or any suitable combination of battery voltages.

In the embodiment with a 3V battery and a 1.5V battery, 4.5V power is routed to terminal Vdd within the controller. If the voltage across Vdd is greater than 4.5V, a Zener diode 21 and an optional resistor 24 may be added to protect controller 11. If batteries 27, 29 are respectively 3V and 1.5V, then 4.5 V power is routed through current-limiting resistor 26 to LEDs 28. The LEDs are connected to pins of controller 11, respectively OUT1, OUT2, and OUT3, where the controller can connect the LEDs to either 3V power or 4.5V power by opening or closing gates within the controller. It should be understood that more than one power level may be used in designing and operating the circuit. It should also be understood that there may be more than three outputs and there may be a plurality of LEDs connected in parallel as shown, so that each LED receives the desired power level. Controllers suitable for this application may include custom-made or tailor-made circuits, such as application-specific circuits. Any controllers that will perform the indicated functions will work well for these purposes.

Figure 3:
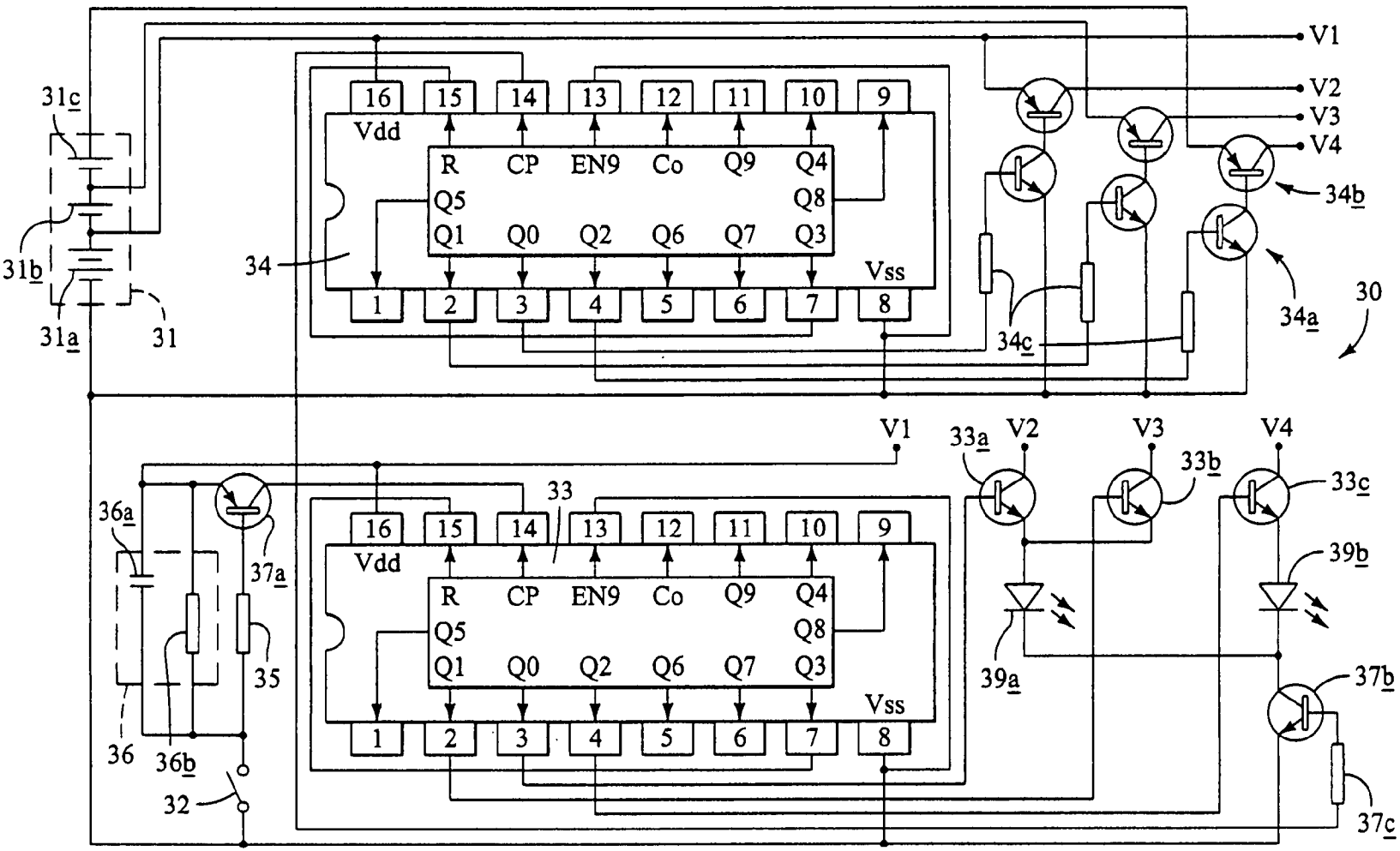
FIG. 3 depicts a block diagram of a third embodiment according to the present invention of a circuit for flashing LEDs.

Another embodiment of a system for power selection for flashing lights is depicted in FIG. 3. FIG. 3 is a block diagram of a system 30 for selecting power levels V2, V3 and V4 to LEDs 39*a* and 39*b* using a decade counter 33 and a second decade counter 34. The system includes a power supply 31, a switch 32, a control circuit 36, primary and secondary control transistors 37*a* and 37*b*, LEDs 39*a* and 39*b*, and a plurality of control transistors 33*a*, 33*b*, 33*c*, 34*a* and 34*b*. Switch 32 may be an inertia switch.

In a preferred embodiment, the decade counters are CD4017 integrated circuits, available from several manufacturers. In FIG. 3, there is a power supply 31 comprising a 3V battery 31*a* connected in series with two 1.5V batteries 31*b* and 31*c*. As shown in FIG. 3, a first voltage, such as 3V power, is routed to pin 16 of decade counter 34 for control power, and a second voltage, which may be 3V, is also routed to a voltage supply transistor 34*b* and to a pin labeled V1. In the illustrated embodiment, the first voltage (V1) and the second voltage (V2) are substantially 3V. Other voltages may be used in other embodiments. The other voltages from power supply 31 are also routed to other voltage supply transistors 34*b*. The voltages available from the collectors of supply transistors 34*b* are thus 3V, 4.5V and 6V, less a small voltage drop across the transistors themselves. Thus, the voltages at pins V1, V2, V3 and V4, in one example of this embodiment, are 3V, 3V, 4.5V and 6V. Other voltages may be used, so long as at least V2 and V3 are different voltages.

The supply transistors 34*b* are controlled by control transistors 34*a*, connected to decade counter 34 through control resistors 34*c*, as shown. Power is routed from the upper V1–V4 pins connected to decade counter 34 to lower V1–V4 pins connected to the decade counter 33. Connections may be made by traces on a printed circuit board, or any other convenient method.

The system 30 is controlled by a switch 32, which may be an inertia switch, or may be a touch switch or a toggle switch, or other suitable switch. Switch 32 completes a circuit with primary gate or primary control transistor 37*a* through resistor 35. There is also a control circuit 36 with a capacitor 36*a* and a resistor 36*b*. Decade counter 33 receives voltage V1 at pin 16 and is otherwise connected as shown in FIG. 3. The circuit also includes secondary control transistor or gate 37*b* and current-limiting resistor 37*c* connected to the cathodes of LEDs 39*a* and 39*b*. In this embodiment, the anode of LED 39*a* is connected to the emitters of two secondary control transistors 33*a* and 33*b*, one of which connects to voltage V2 and the other of which connects to voltage V3. Thus, if decade counter 33 turns on transistor 33*a*, connected to V2, LED 39*a* will receive about 3 volts. However, if decade counter 33 turns on transistor 33*b*, connected to V3, then LED 39*a* will receive 4.5 volts. If decade counter 33 turns on transistor 33*c*, LED 39*b* will receive voltage V4, in this example about 6 volts. In this embodiment, transistors 33*a*, 33*b* and 33*c* are turned on when sufficient base current and base-emitter voltage are provided to place the devices in a forward conducting state. While NPN bipolar transistors are shown in FIG. 3, it is to be understood that other types of transistors may be substituted.

When a user activates switch 32, either by touching a touch switch, or activating an inertia switch, for instance, by walking or running, the control circuit 36 is activated by charging capacitor 36*a* and turning on primary gate or primary control transistor 37*a*. Decade counters 33 and 34 are activated, and a sequence of lights flashing will result for a period of time until capacitor 36*a* is discharged. Decade counter 34 will turn on transistor 37*b*, while decade counter 33 will turn on secondary control transistors or gates 33*a*, 33*b* and 33*c* to flash LEDs 39*a* and 39*b*. In this example, it will be understood that more LEDs may also be connected, some with more than one power level such as LED 39*a*, and some LEDs may be connected only to a single power level, as shown with LED 39*b*. The system may then cause the LEDs to flash in a sequence. The flashing sequence includes power levels, as LEDs may receive a greater voltage and illuminate more brightly, or a lesser voltage and illuminate less brightly.

Figure 4:
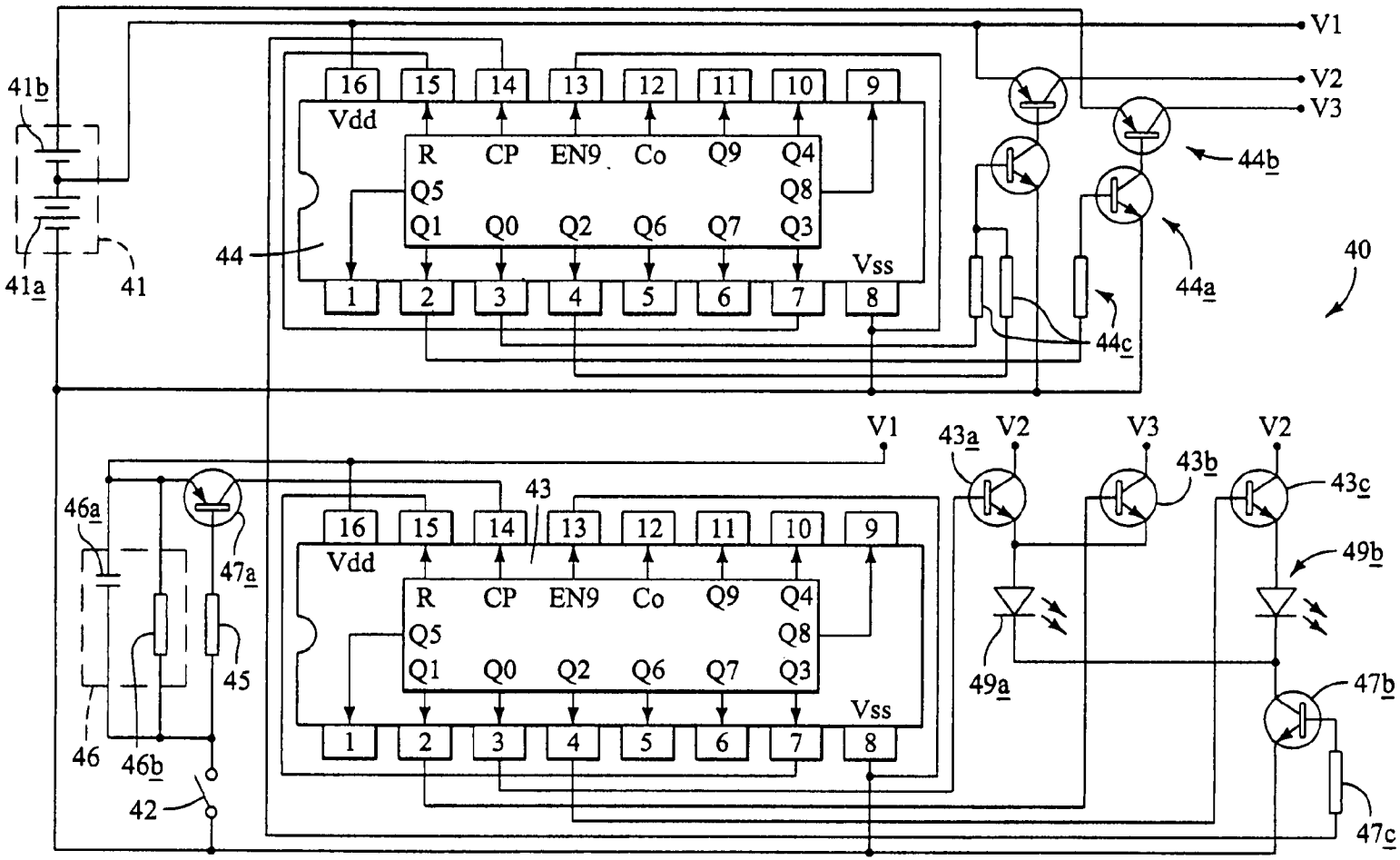
FIG. 4 is a block diagram of a fourth embodiment according to the present invention of a circuit for flashing LEDs.

Another embodiment of a flashing light system with power selection levels is the system 40 for flashing lights depicted in FIG. 4. The system includes a power supply 41, a switch 42 such as an inertia switch or other switch, decade counters 43, 44, and voltages V2, V3 and V4 for routing voltage levels to LEDs 49*a* and 49*b*. The system includes primary and secondary control transistors 47*a*, 47*b*, and other control transistors 43*a*, 43*b*, 43*c*, 44*a* and 44*b*. In this system, power supply 41 includes two batteries 41*a* and 41*b*, which may be 3V and 1.5V batteries. Examples of a 3V battery include a CR2032 battery. Examples of a 1.5V battery include an AG13 battery (L1154). 3V power from power supply 41 is routed to the decade counter 44, to pin 16 for power and control, and is also routed to the pin labeled V 1. 3V power is also routed to the emitter of one voltage supply transistor 44*b*, to the collector of that transistor as "V2." V2 will thus be 3V, less a small voltage drop across transistor 44*b*. 4.5V power is routed from power supply 41 to a second voltage supply transistor 44*b*, producing voltage "V3" at the collector of that transistor. Any combination of batteries voltages suitable for LEDs or other lamps may be used.

The remainder of the circuit includes a decade counter 43, connected to decade counter 44 as shown, and also connected to secondary control transistors or secondary gates 43*a*, 43*b* and 43*c*, as well as LEDs 49*a* and 49*b*, and transistor 47*b* and resistor 47*c*. The system 40 is controlled by switch 42, which may be an inertia switch, a toggle switch, or a touch switch. There is also a primary control resistor 45 and primary gate or primary control transistor 47*a*. A control circuit 46 includes a capacitor 46*a* and resistor 46*b*. This circuit operates in a manner similar to that described for the system of FIG. 3. In this system however, all LEDs, such as LEDs 49*a* and 49*b*, may be connected to voltage level V2, where V2 may be 3V or a little less than 3V. Some LEDs, such as 49*a*, may be connected to both V2 and V3 at different times. Thus, in this example, LED 49*a* may be connected to both V2, about 3V, and to V3, about 4.5V, at different times, through secondary control transistors or secondary gates 43*a* and 43*b*. It will be understood that other voltage levels may be used, and that other components may be used to increase or decrease the voltages available to the LEDs. It will also be understood that a greater number of LEDs may be used in any of the circuits described herein. The flashing or illuminating of lamps or LEDs may also include power levels, as LEDs may receive a greater voltage and flash more brightly, or a lesser voltage and flash less brightly.

Figure 5:
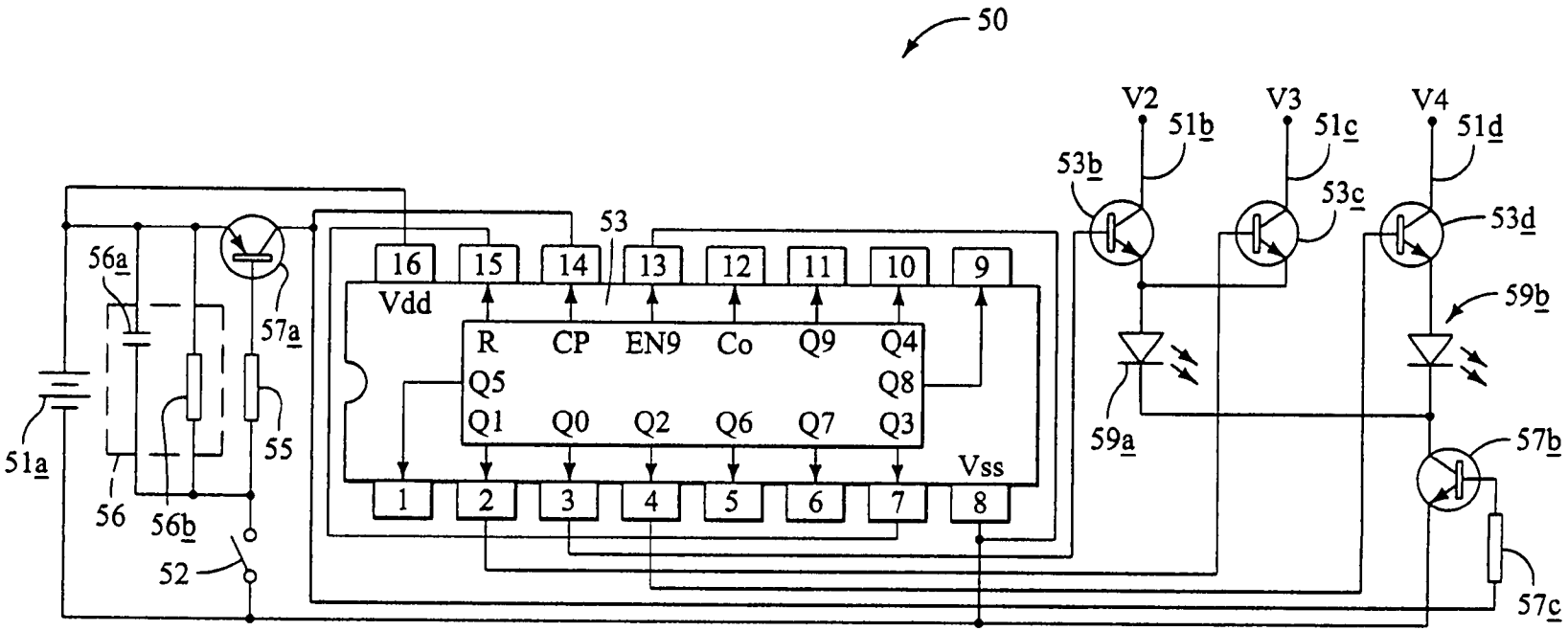
FIG. 5 is a block diagram of a fifth embodiment according to the present invention of a circuit for flashing LEDs.

Another embodiment of a flashing light system with the ability to select a power level is depicted in FIG. 5. This flashing light system 50 with power selection levels includes a control power supply 51*a* and additional voltage sources 51*b*, 51*c* and 51*d*. The system includes a switch 52, a control circuit 56, primary control transistor 57*a* and secondary control transistor 57*b*, controller or decade counter 53, and LEDs 59*a*, 59*b*. Voltage sources 51*a*, 51*b*, 51*c*, 51*d* may be any convenient source of power useful for lighting LEDs, such as batteries. In this embodiment, voltage source 51*b* may be V2, voltage source 51*c* may be V3 and voltage source 51*d* may be V4. Examples of useful voltages may include 1.5V, 3V, 4.5V, 6V, 9V and 12V. Any voltages suitable for LEDs or other lamps may be used.

The circuit includes switch 52, such as an inertia switch, and a control circuit 56, which includes a capacitor 56*a* and a resistor 56*b*. Closing the switch activates primary gate or primary control transistor 57*a*, grounding the base of the transistor through resistor 55. This begins a flashing sequence with controller 53. In one embodiment, controller 53 may be a decade counter. The decade counter controls secondary control transistors 53*b*, 53*c*, 53*d* and control transistor 57*b* through resistor 57*c*. There may also be resistors connected between the gates of control transistors 53*b*, 53*c* 53*d* and controller 53. The flashing sequence turns on secondary control transistors or gates 53*b*, 53*c*, 53*d*, one at a time, to illuminate the lamps or LEDs. Thus, when transistor 53*b* is turned on, voltage V2 will be routed from voltage source 51*b* through transistor 53*b* to LED 59*a*, and then through control transistor 57*b* to complete the circuit. When transistor 53*c* is turned on, voltage V3 will be routed from voltage source 51*c* through transistor 53*c* to LED 59*a*, and then through control transistor 57*b*. If V2 is different from V3, then LED 59*a* will illuminate first with one power level or brightness, and later with a second power level or brightness. Thus, the flashing lights are designed to illuminate at different brightnesses in response to different power levels. This results in a more varied and interesting flashing pattern. In this embodiment, LED 59*b* receives only V4 power through secondary control transistor 53*d*.

Figure 6:
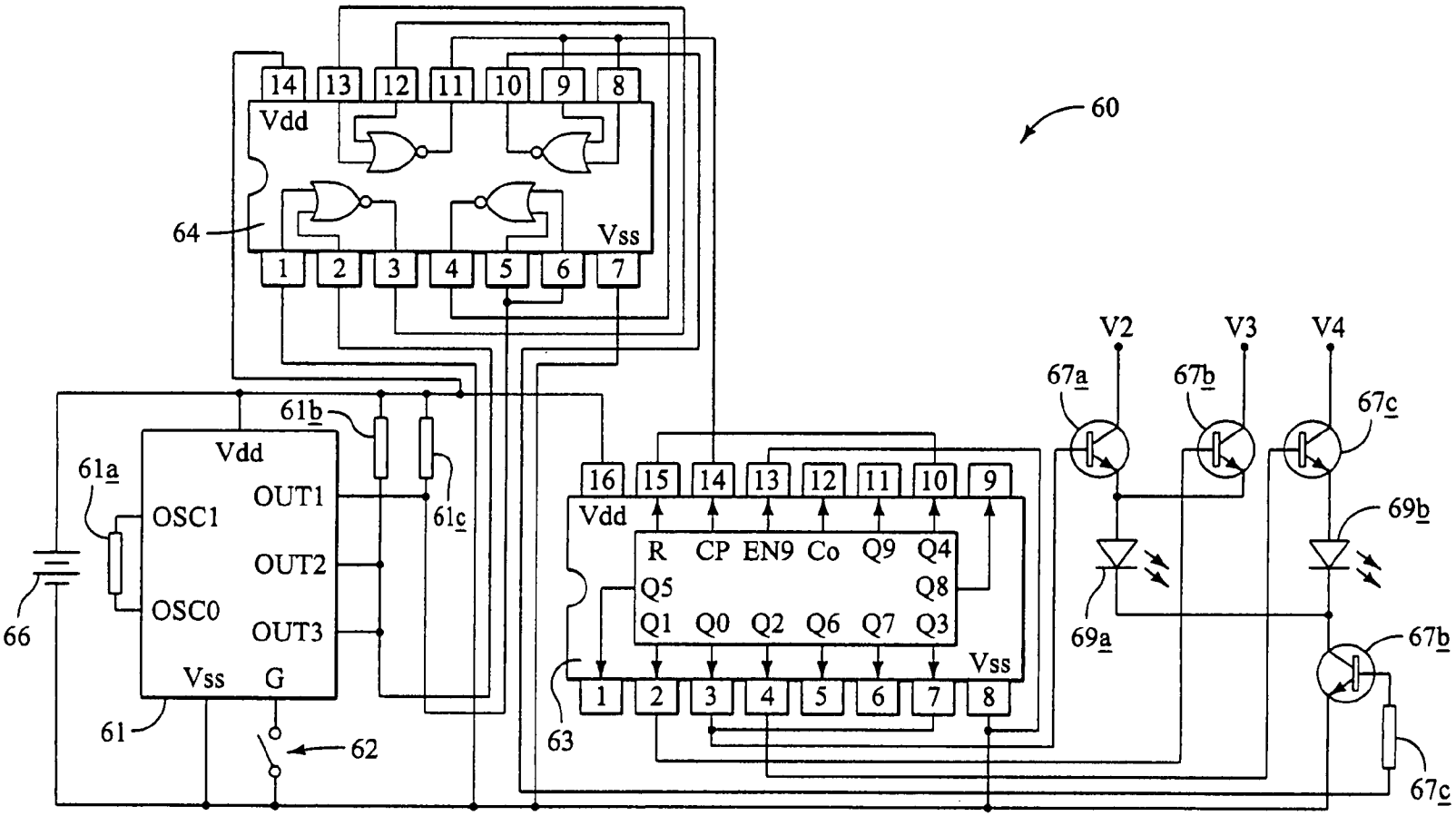
FIG. 6 is a block diagram of a sixth embodiment according to the present invention of a circuit for flashing LEDs.

FIG. 6 depicts another embodiment of a flashing light system 60 with power selection levels. This system 60 includes a controller 61, a decade counter 63 and a quad NOR gate 64. There is a control switch 62 and a control power supply 66. Power supply 66 is preferably a 3V battery. The system includes three voltage levels, V2, V3, V4 for applying power to LEDs 69*a* and 69*b*. Voltage levels V2, V3, V4 may be supplied by batteries in series connected to secondary control transistors 67*a*, 67*b*, 67*c*. These voltages may be the same or may be different, so long as at least two of V2, V3 and V4 are different voltages. The controller 61 may be an 8533 or M1320 or M1389 RC oscillator integrated circuit with a control resistor 61*a*. M1320 and M1389 RC integrated circuits are made by MOSdesign Semiconductor Corp., Taipei, Taiwan. Controller 61 may have an internal timer to limit a time for flashing LEDs 69*a*, 69*b*. Switch 62 may be an inertia switch.

The outputs of controller 61 may be connected through resistors 61*b*, 61*c* as shown to a quad NOR gate 64. Quad NOR gate 64 controls the flashing lights through decade counter 63 and control transistor 67*b* through resistor 67*c*. One or more sequences of flashing lights may be stored flashing light system 60. In this embodiment, voltage V2 or voltage V3 may be routed to LED 69*a* through secondary control transistors or gates 67*a* or 67*b*. Voltage V4 is routed to LED 69*b* through secondary control transistor or gate 67*c*. It will be understood that a greater number of LEDs may be used in any of the circuits described herein. Using flashing patterns stored in the system 60, the system may then cause the LEDs to flash in the footwear or other item. The flashing sequence may also include power levels, as LEDs may receive a greater voltage and flash more brightly, or a lesser voltage and flash less brightly.

A "truth table" may be constructed for the circuit shown in FIG. 6. The "truth table is depicted in FIG. 8. The truth table is meant to depict the outputs of the logic and decade counter circuits used in FIG. 6, designated as numerals 64 and 63 respectively. The columns in FIG. 8 depict the pins in the circuits, and successive rows in the truth table express timing sequences in which a voltage or an output is present or is not present on the indicated pin. In the logic circuit, pin 14 is Vdd and is thus always "on" or "1," indicating that there is a voltage to the circuit, while pin 1 is connected to ground is thus always "off" or "0." In the decade counter, pin 16 is Vdd and is always high or "1," while pin 8 is ground and is always low or "0." Power to the LEDs is represented by the pins 2, 3, and 4 of the decade counter and by pin 10 of the logic. When logic pin 10 is high or "1" and one of pins 2, 3 and 4 is high or "1," the LED connected to output 2, 3, or 4 will flash or light up.

In the truth table of FIG. 8, LEDs will thus flash during the time periods corresponding to rows 1, 3, and 5. The LEDs will flash in sequence. Other sequences may be used. In this example, during the time period corresponding to row 1, pin 3 of the decade counter will be high as will pin 10 of the logic circuit. Thus, transistor 67*a* will conduct and LED 69*a* will be illuminated in response to voltage V2. No power will be applied to any LED during the time period corresponding to row 2, since pin 10 of the logic circuit is low or "0." During the time period corresponding to row 3, pin 10 of the logic circuit is now high or "1," and pin 2 of the decade counter is high or "1." Therefore, transistor 67*b* will conduct, connecting voltage V3 to LED 69*a*, and LED 69*a* will illuminate. During the period corresponding to row 4, pin 10 of the logic circuit goes low or "0," and no LEDs illuminate. During the period corresponding to row 5, pin 10 of the logic circuit goes high or "1," while pin 4 of the decade counter also goes high or "1." Therefore, transistor 67*c* conducts, connecting voltage V4 to LED 69*b*, which then illuminates. The sequence then continues for as long as it has been programmed, or until a capacitor in the circuit discharges.

Figure 7:
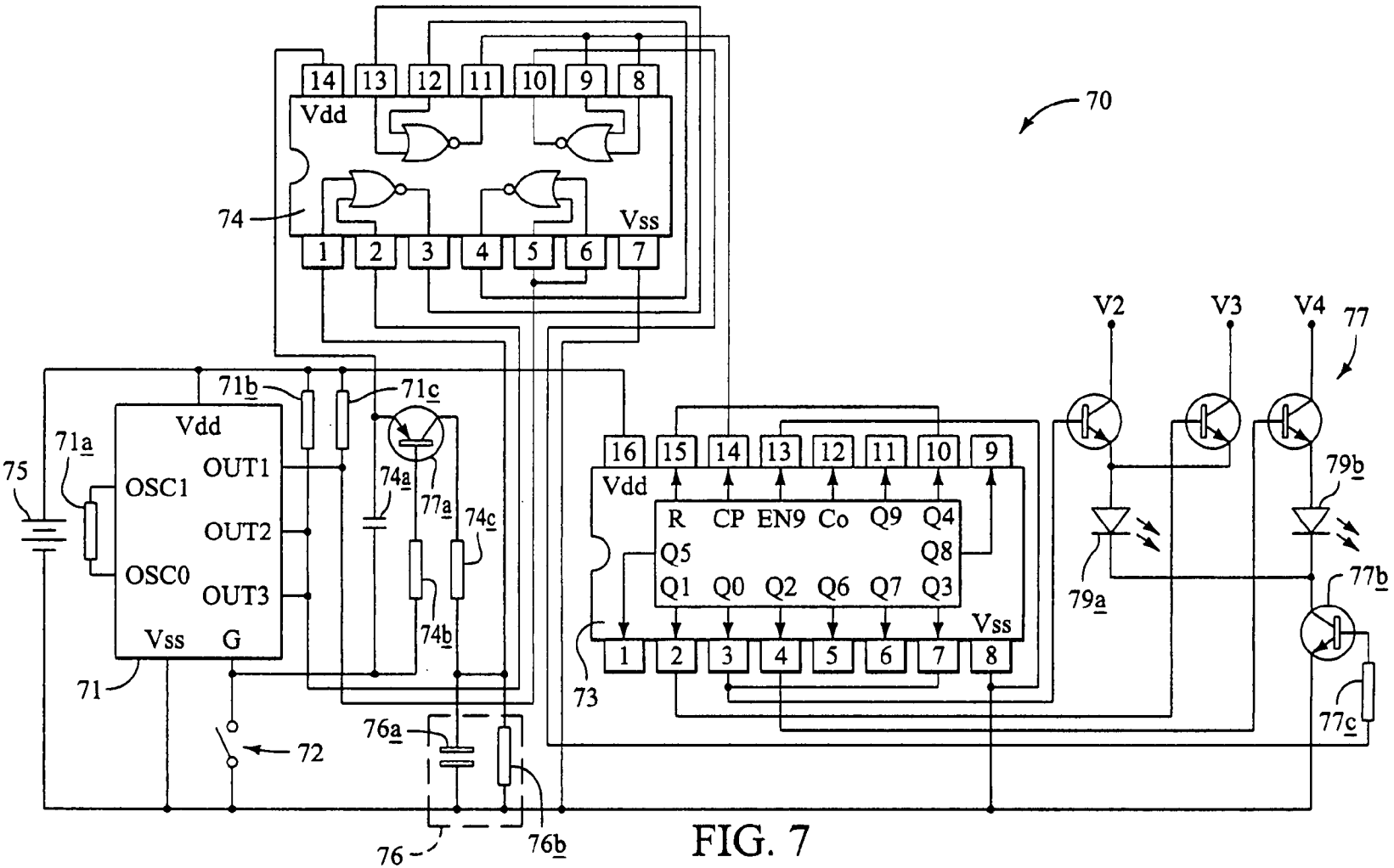
FIG. 7 is a block diagram of a seventh embodiment according to the present invention of a circuit for flashing LEDs.

Another embodiment of a flashing light system with power selection levels is system 70, depicted in FIG. 7. The system 70 of FIG. 7 is preferably manufactured in a complementary metal-oxide semiconductor (CMOS) implementation on a single integrated circuit, such as an M1320 or M1389 integrated circuit made by MOSdesign Semiconductor Corp., Taipei, Taiwan, in order to save cost and space. A toggle switch or other on/off switch also helps to preserve battery life. It is understood that most of the components of the system will be included in the integrated circuit, with the exception of the LEDs, the power supplies or batteries, and one or more switches. In the embodiment of FIG. 7, there is an RC oscillator integrated circuit 71, with circuits equivalent to an 8533, M1320 or M1389 RC oscillator integrated circuit. There is a logic circuit 74, with circuits equivalent to a CD4001 quad NOR gate, and a decade counter 73, with circuits equivalent to a CD4017 decade counter/divider. These circuits are connected as shown in FIG. 7. Operation of the circuit is controlled by a switch 72 and a control circuit 76 that includes a capacitor 76*a* and a resistor 76*b* as shown. Switch 72 is preferably an inertia switch.

The integrated circuit 71 may include a control resistor 71*a* and output resistors 71*b*, 71*c* connecting oscillator 71 to quad NOR gate 74. The circuit includes primary gate or primary control transistor 77*a*, capacitor 74*a*, gate resistor 74*b* and primary control resistor 74*c*. Decade counter/divider 73 stores one or more flashing sequences for LEDs 79*a*, 79*b*, and connects the LEDs to voltages V2, V3, V4 through secondary control transistors or secondary gates 77. Quad NOR gate 74 controls primary control transistor or primary gate 77*b* through control resistor 77*c* to complete the circuit for the LEDs. Voltages V2, V3 and V4 may be the same or may be different, so long as at least two are different voltages. The voltages may be supplied by batteries in series connected to points V2, V3, and V4. Power supply 75 is preferably a 3V battery, a 4.5V battery, or a 6V battery.

Figure 9:
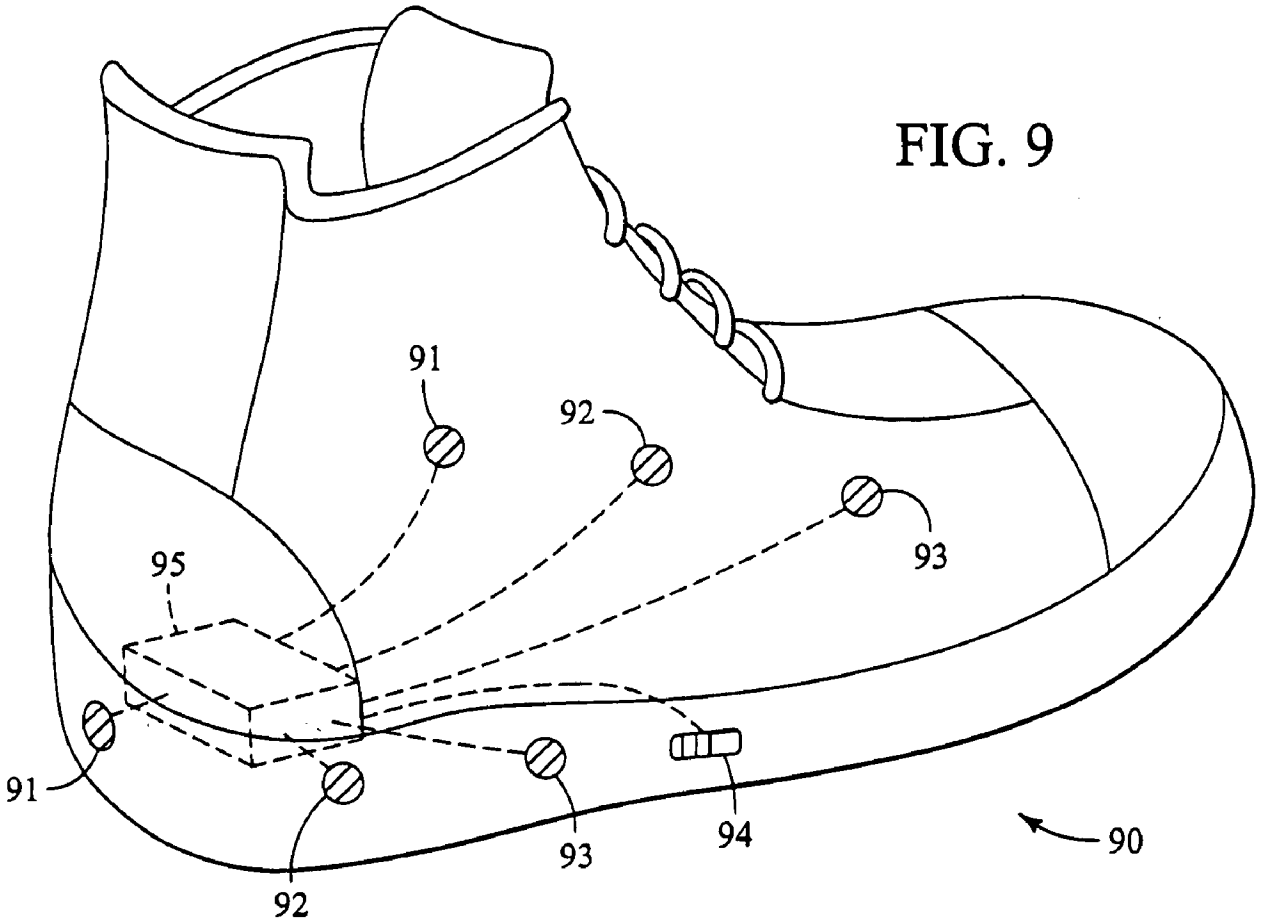
FIG. 9 depicts a shoe with a flashing light system according to the present invention.

FIG. 9 depicts a shoe 90 that incorporates the flashing light system with power selection levels. The shoe includes a flashing light system controller 95 with an inertia switch inside controller 95 for activation by running or other motion by the wearer of the shoe. The system may also include a toggle or on/off switch 94 placed on the outside of the shoe so that the wearer may turn the system on or off. The system includes a plurality of lamps or LEDs 91, 92, 93 placed for visibility on an outside surface of the shoe for flashing by the controller 95. In this embodiment, LEDs 91 may be green, LEDs 92 may be blue, and LEDs 93 may be red. The system and controller 95 may include two or more batteries as described above for delivering at least two voltage levels in succession to the LEDs.

Figure 11:
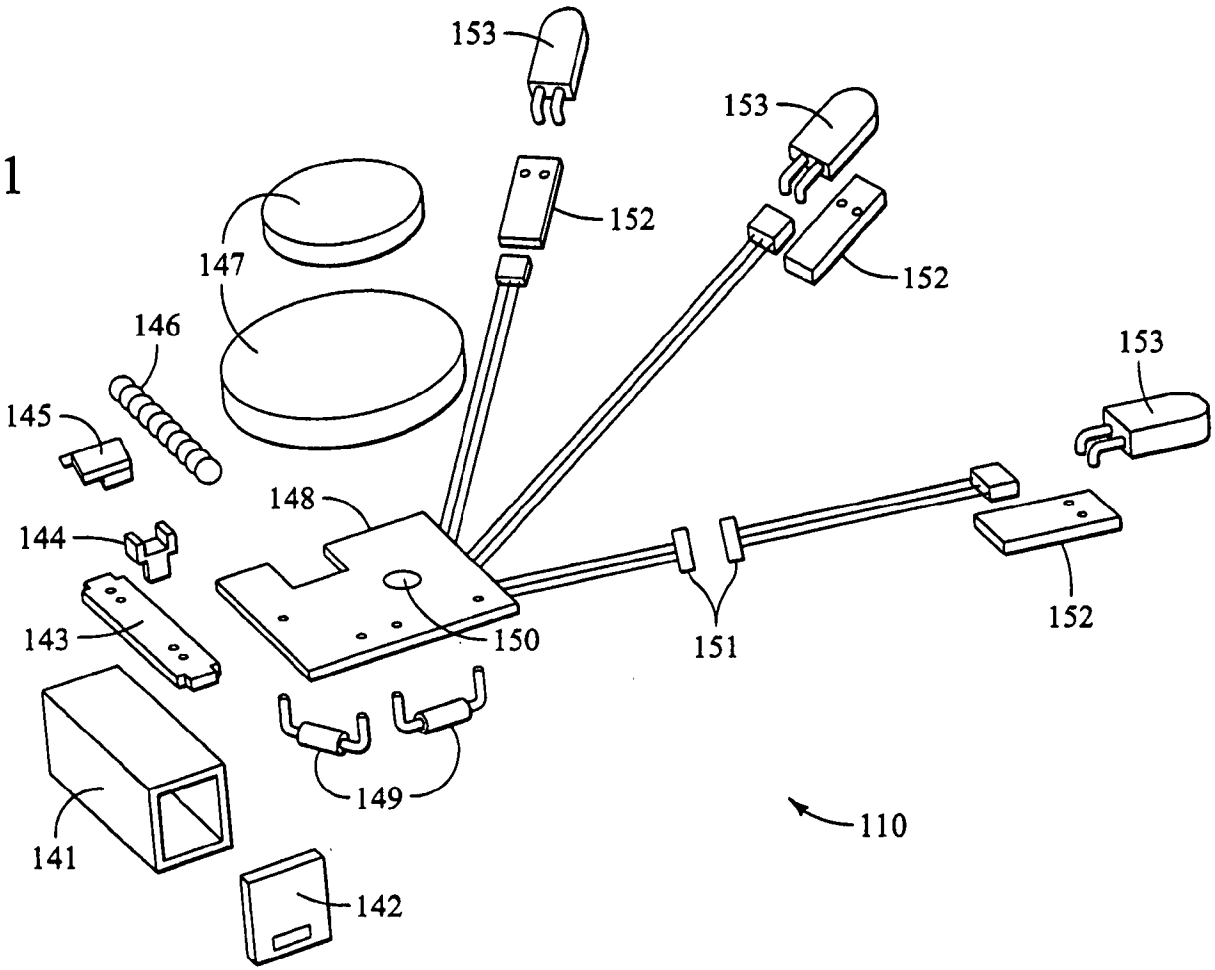
FIG. 11 depicts components of one embodiment of a flashing light system suitable for a shoe.

FIG. 11 depicts the components of one embodiment of a flashing light system 110 for use in footwear. The components include a motion or inertia switch with a spring housing 141 and housing cover 142, a small printed circuit board (PCB) 143 inside the housing, a spring stand 144, a spring contact 145, and a spring 146. One end of spring 146 is usually soldered or otherwise attached to spring stand 144. The system also includes at least two batteries 147 and a printed circuit board 148. A controller 150 and resistors 149 are mounted on the printed circuit board (PCB) 148. Lamps or LEDs 153 are connected to the controller and power source via wires and connectors 151 or by wires directly. The lamps or LEDs and one of the wire ends may also be mounted with mounting connectors or PCBs 152. The motion of a shoe bounces spring 146 to momentarily contact spring contact 145 and completes the circuit, bring power to the controller and beginning a sequence of flashing lights. LEDs may include any size and shape, and preferably include 5 mm round shapes, 5 mm flat shapes, and 3 mm round shapes.

Figure 10:
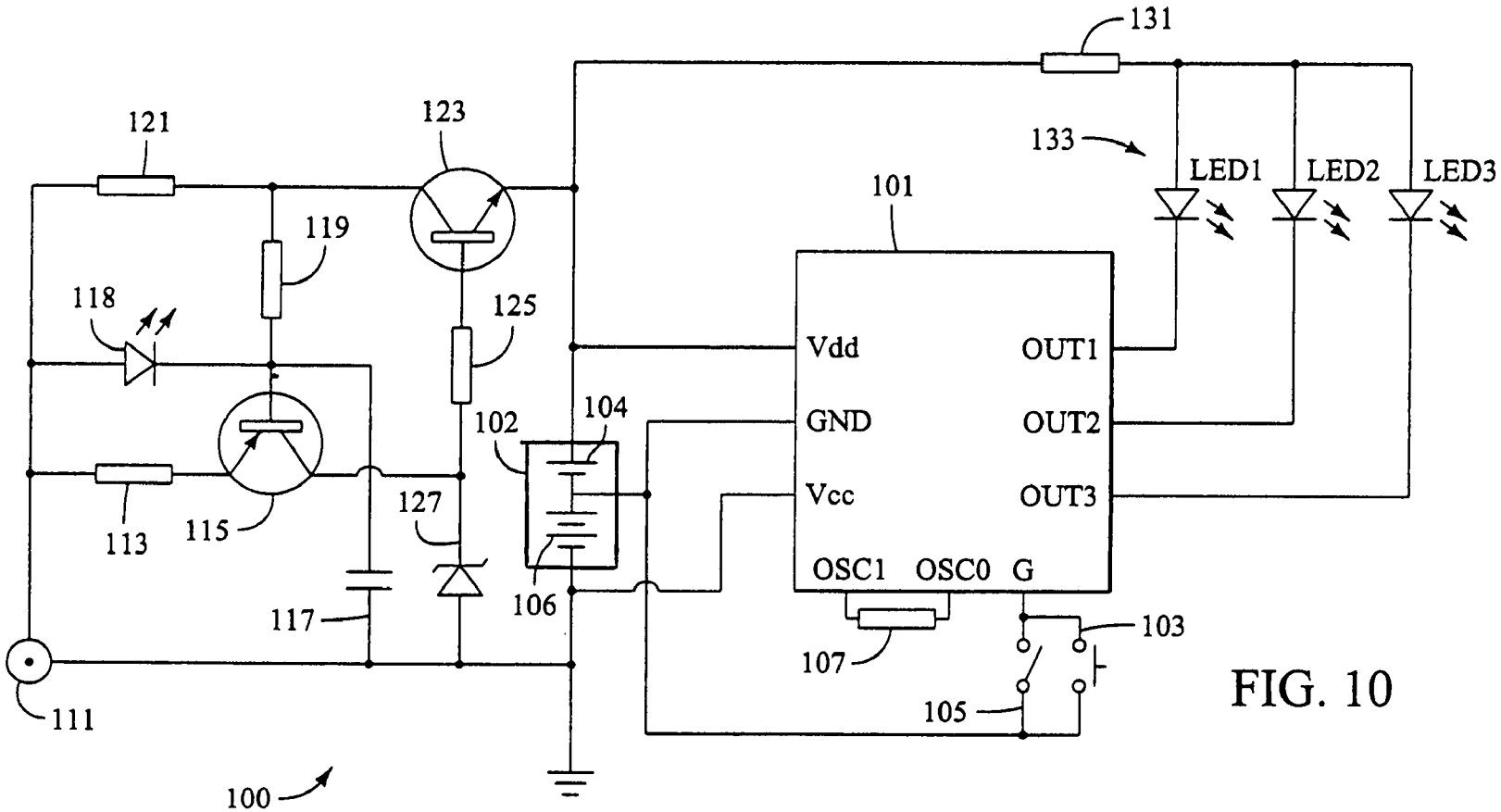
FIG. 10 depicts another embodiment of a flashing light system incorporating a battery charger.

Another embodiment of the invention is a flashing light system 100 that includes a battery charging circuit. FIG. 10 depicts such an embodiment. There is a controller 101, a power supply 102 with at least two batteries 104, 106, and switches 103, 105. Switch 103 may be an inertia switch and optional switch 105 may be a toggle switch or other convenient and useful switch. The controller routes power through resistor 131 to LEDs 133. The circuit of 101 may route LEDs 133 to one of at least two different voltages within controller 101, such as 3V and 4.5V through pins OUT1, OUT2, and OUT3, for LED1, LED2 and LED3 respectively.

The battery-charging portion of the circuit includes an input jack 111 for inputting suitable recharging power. The recharging voltage should be the sum of batteries 104, 106 within the power supply 102. Thus, if batteries 104, 106 are each 4.5 V, then 9V input DC power should be used to recharge the batteries. If the battery has run down, and the base-emitter voltage difference across transistor 123 is greater than about 0.7V when DC power is applied to jack 111, transistor 123 will conduct and will charge batteries 104, 106. The circuit includes a capacitor 117 which charges up, turning on transistor 115 and then transistor 123. The batteries charge up, conducting current through LED 118 so that a user may monitor the charging. The process is regulated by resistors 113, 119, 121, and 125, and a Zener diode 127, which controls the desired voltage across the power supply during re-charging. Other recharging circuits may be used instead.

Figure 12:
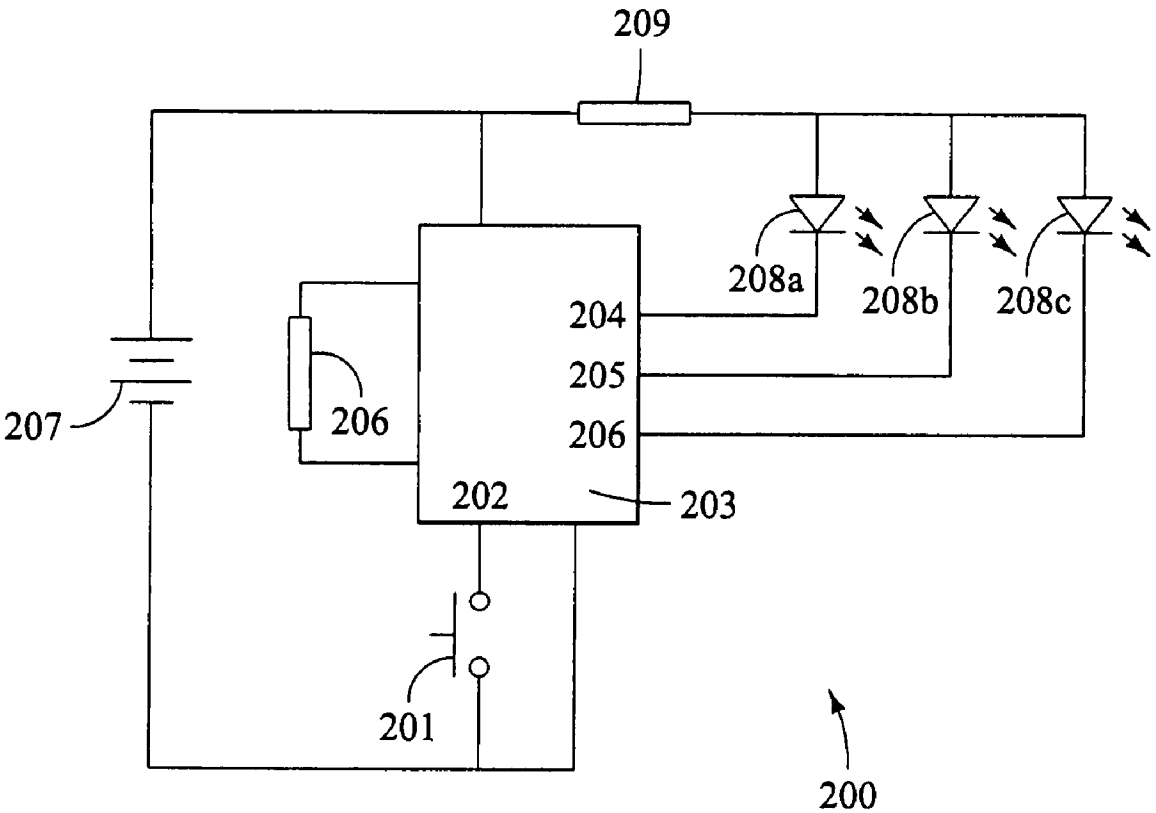
FIG. 12 Prior Art
FIG. 12 depicts a prior art embodiment of a flashing light system.

FIG. 12 is a prior art flashing light system 200 with a single voltage source 207. The flashing light system is controlled by an inertia switch 201 and controller 203. Controller 203 may be any controller capable of receiving a signal from inertia switch 201 through input 202 and activating flashing light system 200 to flash LEDs 208*a*, 208*b*, 208*c*. Typically, the system will include an oscillator or control resistor 206 connected with controller 203 and a current-limiting resistor 209 to limit the current when the system activates a voltage to LEDs 208*a*, 208*b*, 208*c* through outputs 204, 205, 206 of controller 203. Controller 203 may be an integrated circuit, such as MC14017BCP, CD4107AF, made by many manufacturers, or may be a custom or application specific integrated circuit, or may be a CMOS circuit. Other examples include M1320 and M1389 RC integrated circuits are made by MOSdesign Semiconductor Corp., Taipei, Taiwan. Another example is a controller made with CMOS technology, such as model EM78P153S, made by EMC Corp., Taipei, Taiwan. Any of these controllers may also be used in the embodiments of FIGS. 13 and 14.

Figure 13:
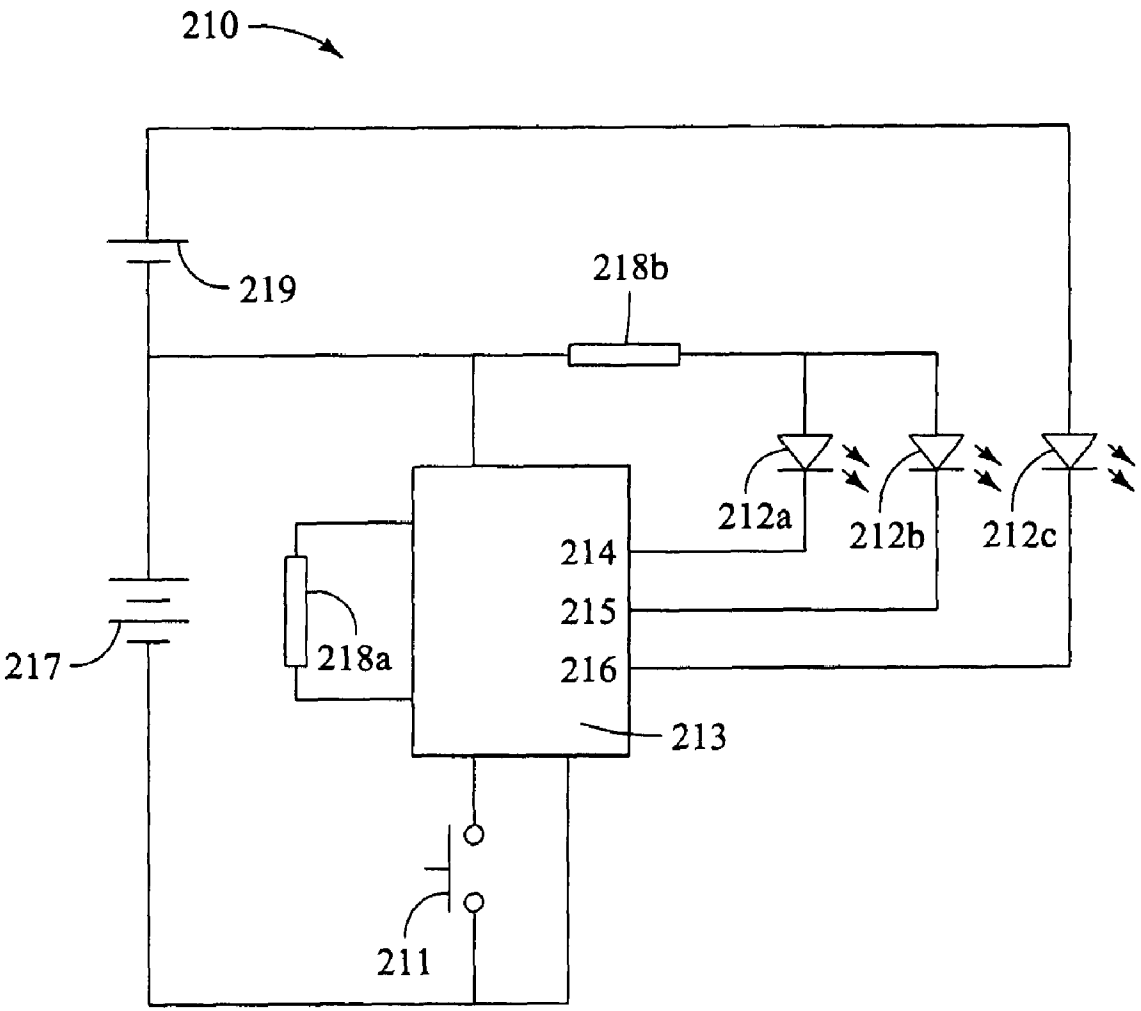
FIG. 13 depicts an embodiment of a flashing light system with two batteries.

FIG. 13 is an embodiment of a flashing light system with more than a single power level. Flashing light system 210 comprises an inertia or spring switch 211, LEDs 212*a*, 212*b*, 212*c*, and a controller 213 for controlling the system. There may be an oscillator or control resistor 218*a* and a current limiting resistor 218*b*. The power sources or batteries 217, 219 may be the same voltage, such as two 3V batteries, or may be different voltages, such as a 3V battery and a 1.5 V battery. In the embodiment shown in FIG. 13, battery 217 may be 3V and is connected to LEDs 212*a*, 212*b* through current limiting resistor 218*b*. Batteries 217, 219 are connected in series, such that the controller and LEDs 212*a*, 212*b* receive 3V. LEDs 212*a*, 212*b* may be lower voltage LEDs, such as red, green, or yellow LEDs, using 1.8 V to 3.0V. If battery 219 is 1.5V, then the two batteries in series are 4.5V and are connected to LED 212*c*. LED 212*c* may be a higher voltage level LED, such as an LED that is blue, white, pink, bright green or bright yellow. It is preferable to use 3V to 6V as an operating voltage for these LEDs.

Figure 14:
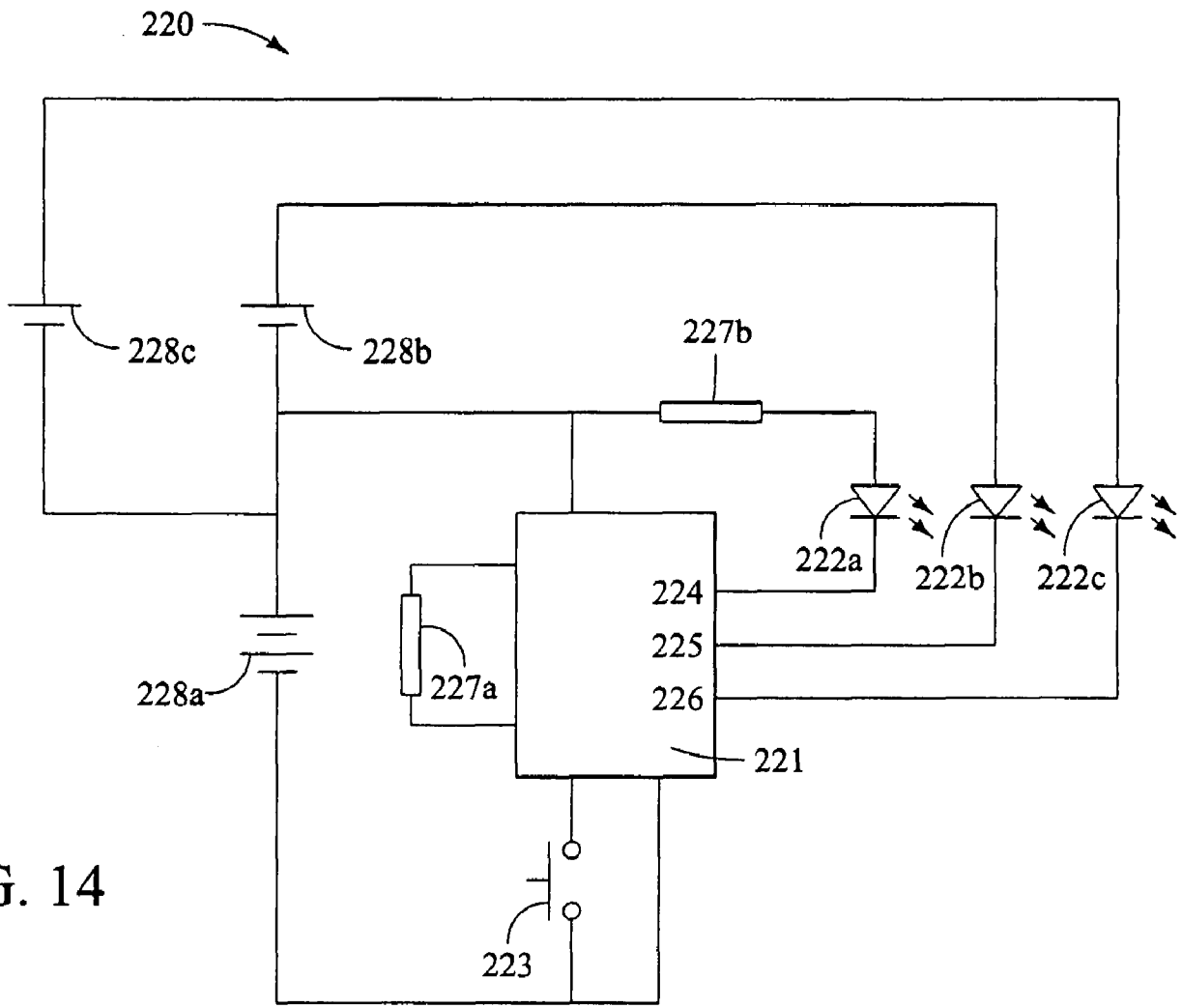
FIG. 14 depicts an embodiment of a flashing light system with three batteries.

FIG. 14 is another embodiment of a flashing light system 220 with two batteries. Flashing light system 220 includes a controller 221 as described above for FIG. 13, and also comprises an inertia switch 223 for activating the system. The controller may also include a control resistor 227*a*. Battery 228*a*, which may be a 3V battery, is connected in series with batteries 228*b*, 228*c*, which are connected in parallel. Battery 228*a* is then connected to supply power to controller 221 and also to LED 222*a* through output 224 of the controller. There may also be a current-limiting resistor 227*b* in the circuit. Battery 228*a* is connected in series with battery 228*b*, which may be a 1.5V battery, wherein the combination will yield 4.5V connected to LED 222*b*. In a similar manner, battery 228*a* is connected in series with battery 228*c*, which may also be a 1.5V battery. The series connected batteries are connected to the anode of LED 222*c*, which may be a higher-voltage LED, as described above for FIG. 13. LEDs 222*b*, 222*c* may thus be higher voltage LEDs, each with its own power supply, and connected to controller 212 through outputs 225, 226. Other embodiments are possible with greater or fewer LEDs and with additional power sources.

The flashing light systems may be programmed to illuminate with different flashing patterns, and they may be programmed to illuminate with a different flashing pattern each time the system is activated. For instance, if there are three LEDs, the LEDs may flash in sequence 1,2,3,1,2,3 . . . and then stop automatically. The next time the system is activated, the system may flash in sequence 2,3,1,2,3,1 . . . . The third time the system is activated, the system may flash in sequence 3,2 1 3,2,1, and so on. The system will then flash these patterns in this sequence for further activations of the circuit.

Other patterns may also be used. For instance, if a flashing light system has six LEDs, they may flash in sequence in at least six different ways, beginning with the first LED, the second LED, and so on to the sixth LED. It is also possible for the six LEDs to flash in only three sequences, such as 1,2,3,4,5,6.

It will be understood that embodiments covered by claims below will include those with one of the above circuits, as well as circuits in which most of the components are integrated into a single integrated circuit, so that economy of operation may be achieved, while at the same time providing for a variety of pleasing applications. Components not included in the integrated circuit will include larger items, such as batteries, switches, the LEDs themselves, and the like.

Figure 15:
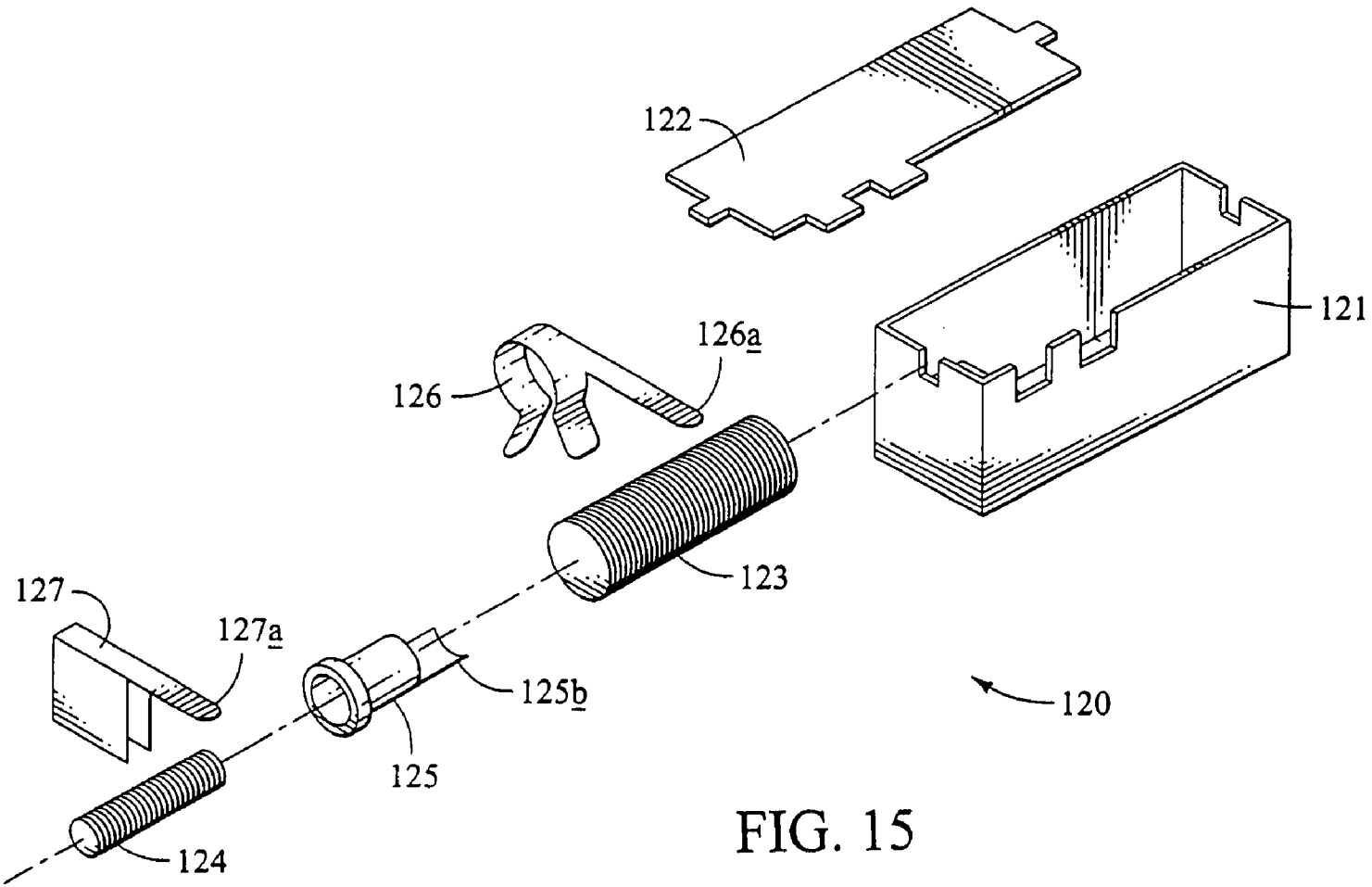
FIG. 15 depicts an embodiment of an inertia switch.
Figure 16:
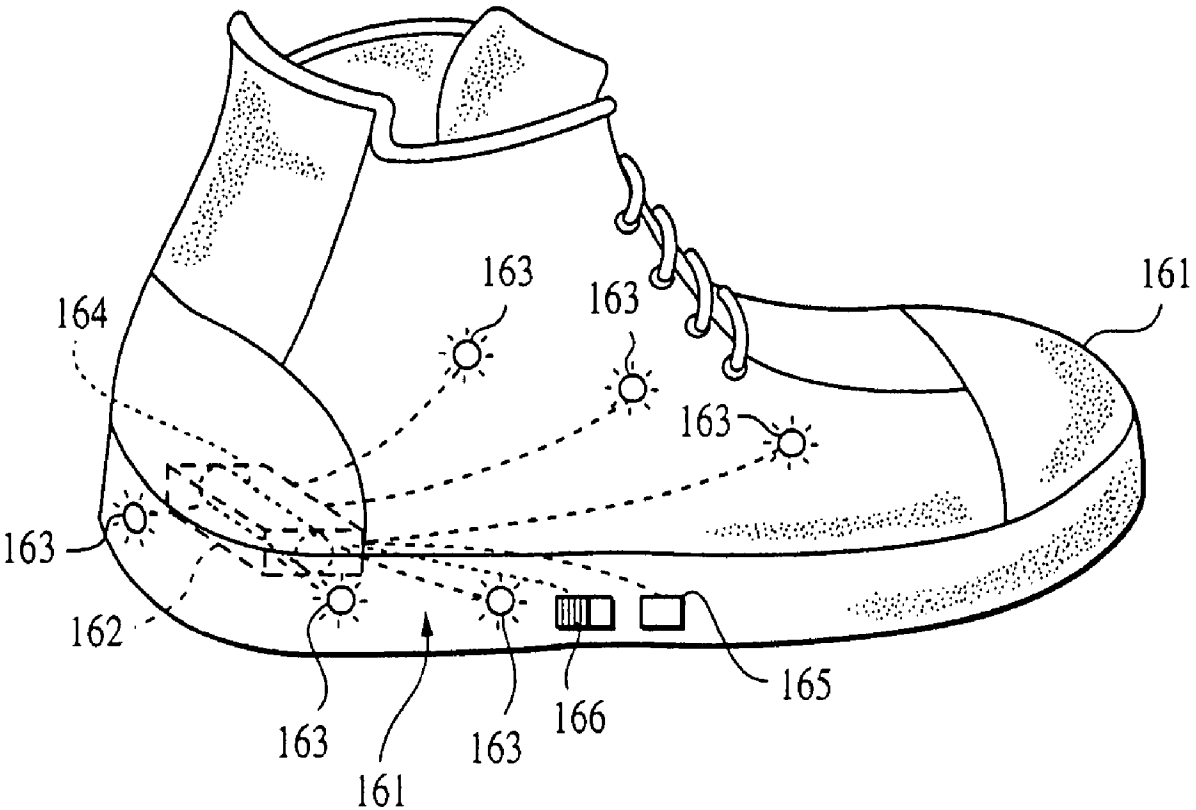
FIGS. 16–21 depict clothing and personal accessories that may use flashing light systems in accordance with the present invention.

Inertia switches, as mentioned above, are used in embodiments of the flashing light systems according to the present invention. One such inertia switch, meant as one possible embodiment of inertia switches generally, is depicted in FIG. 15. Inertia switch 120 comprises a nonconductive housing 121 and nonconductive housing closure 122. The switch also comprises a smaller coil spring 124 and a larger coil spring 123, separated by an insulating directional sensing regulator 125. Regulator 125 has an elongated portion 125*b* for a portion of its outer circumference. The switch also has first contact 126 soldered to large spring 123, first contact 126 having an elongated portion 126*a* for connecting or assembling to an outside electrical circuit in which switch 120 is used. Switch 120 has a second contact 127 soldered to small spring 124. Second contact 127 has an elongated portion 127*a* for also connecting or assembling to a circuit in which switch 120 is used. Contacts 126*a*, 127*a* protrude through housing 121 for making contact with a flashing light system as described above.

Figure 17:
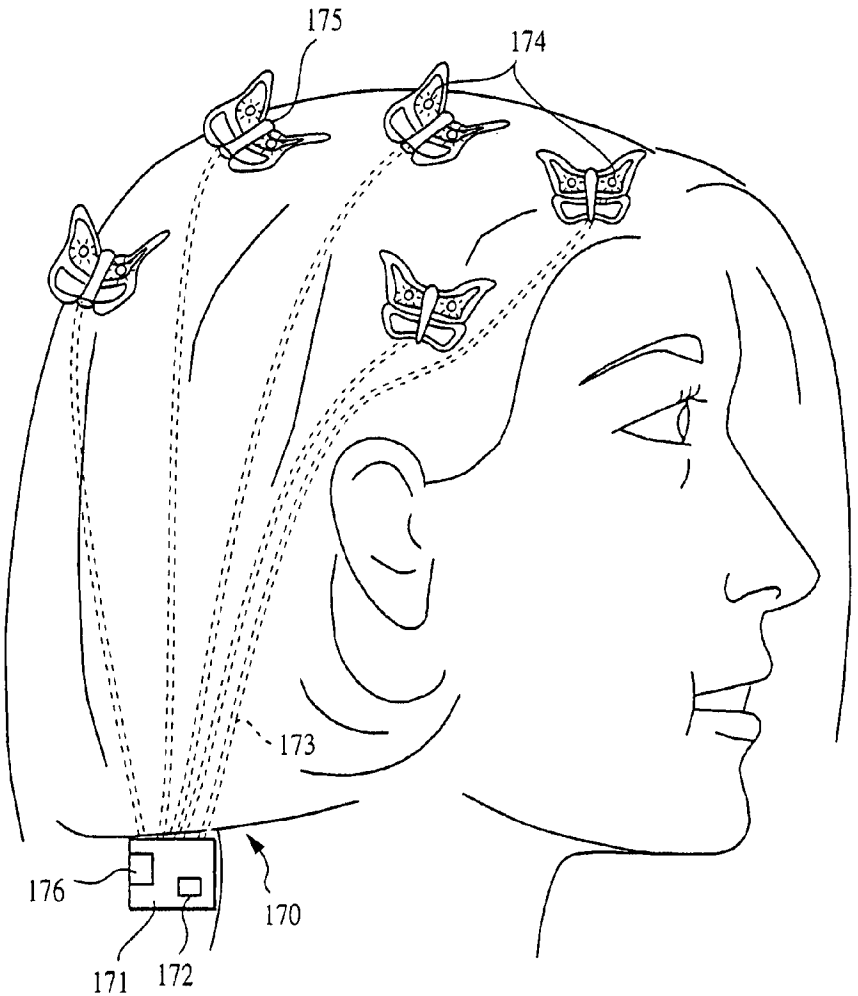

There are many applications for illuminating systems using inertia switches as described above. Such illuminating systems may be used on a variety of personal clothing and accessories. FIGS. 16–21 depict a few of these accessories, including FIG. 16, with a shoe 161 that incorporates the illuminating system 162 with LEDs 163, and having an inertial switch 164 and a touch switch 165. Either switch may be used to initiate or to change illumination patterns, as described above. The system also includes a toggle switch 166 for disconnecting the power supply (internal 3V battery) from the circuit. FIG. 17 depicts another application, using an LED in each of a plurality of hair clips for a woman. Illumination system 170 includes a system power and control portion 171 and an inertia switch 172 for turning the systems and LEDs on. The system includes a plurality of connector elements 173 connecting system controls 171 with LEDs 174 on hair clips 175. The control system may also have a toggle switch 176 to disconnect the battery from the rest of the circuit, conserving power.

Figure 18:
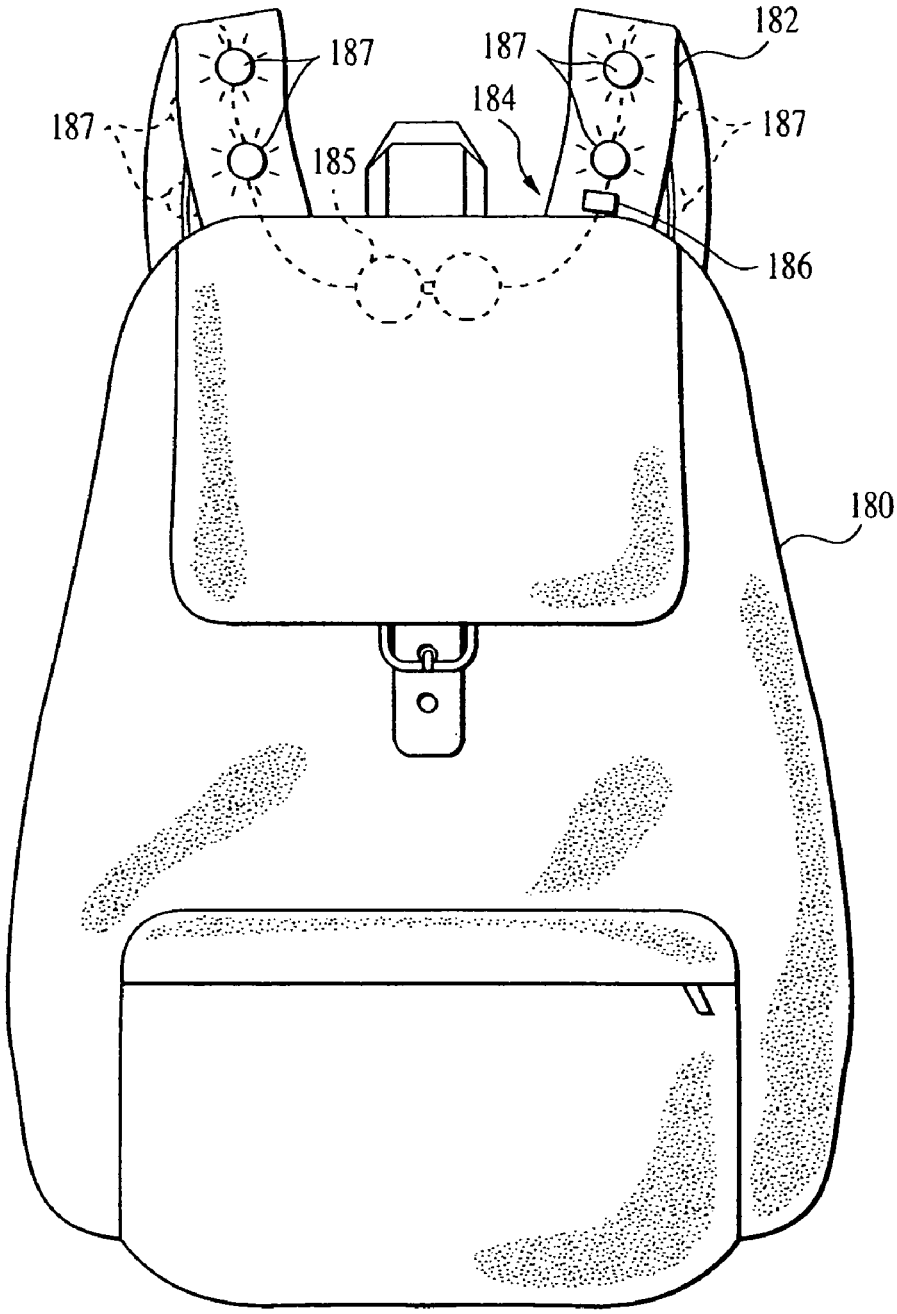

FIG. 18 depicts another application, a back pack 180 with straps 182 for displaying a plurality of flashing LEDs. In this application, the illumination system 184 includes a power and control portion 185, an inertia switch 186 for turning the system on and off, and a series of two-color (red/green) three-lead LEDs 187 on the straps of the backpack. The system power and control portion 185 may be contained in the top flap of the backpack. In this application, the control system may be programmed to alternate red-color LEDs on the left side with red-color LEDs or green-color LEDs on the right side, or vice-versa, in sequence. Of course, two-color LEDs in other colors may also be used, any colors commercially available, and there is no intention to limit this application to two-color LEDs alone. Single-color LEDs may also be used. This is also a good application for in-phase illuminating, in which the LEDs closest to the pack are illuminated, and then the middle pair, and finally the pair farthest away form the back pack, and so on. Other sequences or random flashing may also be used.

Figure 19:
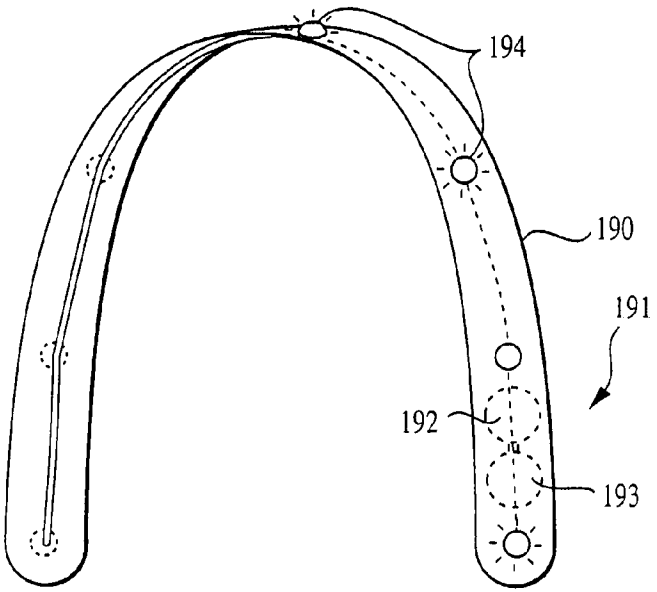
Figure 20:
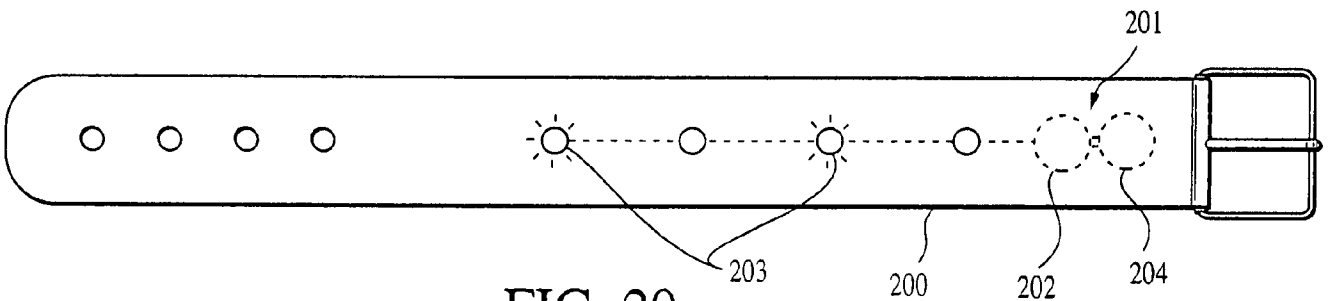
Figure 21:
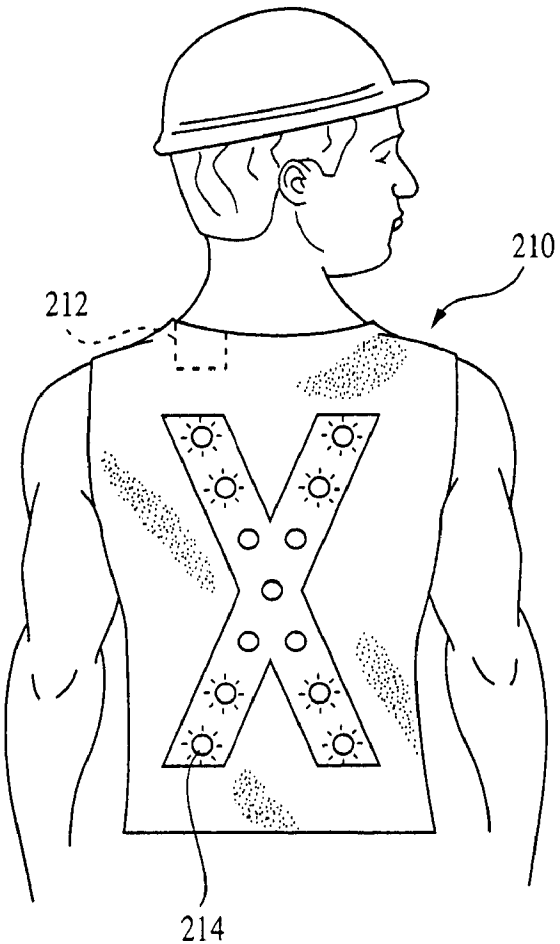

Other accessories which may desirably employ embodiments of a flashing light system include the hairpiece of FIG. 19, a belt, as shown in FIG. 20, and a garment, such as a safety vest for a highway construction worker, shown in FIG. 21. The hairpiece 190 is desirably made of plastic in an attractive and stylish fashion. There may be niches in the underside of the piece to accommodate the power and control portion 192, including an inertia switch (not shown) of the illuminating system 191. It may also be convenient to mold in at least one niche for a control switch 193 for a user to control the illumination or flashing patterns of the system 191. The LEDs 194 are then displayed on the top-side of the hair piece for decorative and stylistic purposes.

A belt 200 may also incorporate a system 201 of flashing lights 203. In this application, the belt has a small space on its underside for attachment of the control system 202 (including an inertia switch) and power supply 204. The LEDs 203 are also strung on the underside and protrude through to the outside of the belt. FIG. 21 depicts a highway worker wearing a safety vest with a flashing light system 210, including control and power supply portions 212 and a pattern of lights 214 in the shape of a large "X" on the vest. Other garments may also be equipped with a flashing light system, such as a coat, a pair of pants, or a protective suit. Any of these circuits may incorporate the features discussed above, including bi-color LEDs, a toggle-switch to turn off the circuit, and an inertia switch to increment and control the flashing.

Any of the several improvements may be used in combination with other features, whether or not explicitly described as such. Other embodiments are possible within the scope of this invention and will be apparent to those of ordinary skill in the art. For example, most of the embodiments described have used light emitting diodes (LEDs) as a light source; other lamps, such as incandescent lamps may be used. In another example, two-color LEDs may be used, the two-color LEDs connected with one anode and two cathodes, or in which the anode of one is the cathode of the other. Therefore, the invention is not limited to the specific details, representative embodiments, and illustrated examples in this description. Accordingly, the invention is not to be restricted except in light as necessitated by the accompanying claims and their equivalents.

What is claimed is:

1. A flashing light system, comprising:

a controller, the controller further comprising a memory, the memory storing data defining at least two sequences for flashing the light sources;

an inertia switch connected to the controller;

a first power source connected to the controller;

a second power source connected in series to the first power source;

at least one first light source connected with the controller to receive power from the first power source; and at least one second light source connected with the controller to receive power alternately from the first and second power sources.

2. The system of claim 1 wherein the controller comprises at least one of an integrated circuit, an application specific integrated circuit, and a CMOS circuit.

3. The system of claim 1, wherein the first power source is a 3V battery and the second power source is a 1.5V battery.

4. The system of claim 1, wherein the at least one light source connected to the first power source comprises at least one LED selected from the group consisting of low voltage LEDS, 2.7V LEDs, 3V LEDs, red LEDs, green LEDs, and yellow LEDs.

5. The system of claim 1, wherein the at least one light source connected to the second power source comprises at least one LED selected from the group consisting of medium voltage LEDS, 4.5V LEDs, 4.9V LEDs, blue LEDs, white LEDs, pink LEDs, bright green LEDs, and bright yellow LEDs.

6. The system of claim 1, wherein at least one of the light sources connected to the first power source and the second power source is connected to receive power from the first power source and is also connected to receive power from the series-connected first and second power sources.

7. The system of claim 1, further comprising a third power source connected in series with the first power source, and at least one light source connected with the controller to receive power from the first and third power sources.

8. The system of claim 1, further comprising a battery charging circuit connected to at least one of the voltage sources.

9. The system of claim 1, further comprising an item selected from the group consisting of footwear, an article of clothing, and a personal accessory.

10. A flashing light system for footwear, the system comprising:

a first power source connected to supply power to at least a first light source;

a second power source connected in series with the first power source to supply power alternately from the first and second power sources to at least one second light source;

a battery charging circuit connected to at least one of the first and second power sources;

a controller configured to receive power from at least one of the power sources; and at least one inertia switch connected to the controller, wherein the switch and the controller are configured to control application of power from the power sources to the light sources.

11. The flashing light system of claim 10, further comprising a third light source, and a third power source connected in series with the first power source to supply power to the third light source.

12. The flashing light system of claim 10 wherein the controller comprises at least one of an integrated circuit, an application specific integrated circuit, and a CMOS circuit.

13. The flashing light system of claim 10, wherein the first power source is a 3V battery and the second power source is a 1.5V battery.

14. The flashing light system of claim 10, wherein the at least one light source connected to the first power source comprises at least one LED selected from the group consisting of low voltage LEDS, 2.7V LEDs, 3V LEDs, red LEDs, green LEDs, and yellow LEDs.

15. The flashing light system of claim 10, wherein the at least one light source connected to the second power source comprises at least one LED selected from the group consisting of medium voltage LEDS, 4.5V LEDs, 4.9V LEDs, blue LEDs, white LEDs, pink LEDs, bright green LEDs, and bright yellow LEDs.

16. The flashing light system of claim 10, further comprising at least one transistor connected between the light sources and the controller.

17. The flashing light system of claim 10, further comprising a capacitor connected to the controller for illuminating at least one light source after the inertia switch opens.

18. The system of claim 10, further comprising footwear assembled with the flashing light system.

19. A method for illuminating footwear with a flashing light system, the method comprising:

connecting a first voltage source to at least one first light source;

connecting a second voltage source to at least one second light source;

illuminating the at least one first light source;

illuminating the at least one second light source; and controlling a timing and at least two patterns of illumination of the light sources with an inertia switch and a controller comprising a memory with at least two sequences for flashing the light sources, wherein at least the second light source is connected alternately first to the second voltage source and then to the first voltage source.

20. The method of claim 19, further comprising connecting the first and second voltage sources in series.

21. The method of claim 19, further comprising connecting a third voltage source in series with the first voltage source, and illuminating at least one third light source with the third voltage source in series with the first voltage source.

22. The method of claim 19, further comprising changing the pattern of illumination with sequential pulsing of the inertia switch.

23. A flashing light system, comprising:

a controller comprising a memory with at least two sequences for flashing the light sources;

an inertia switch connected to the controller;

a first power source connected to the controller;

a second power source connected in series to the first power source;

a low-voltage light source connected with the controller to receive power from the first power source; and a medium voltage or a high-voltage light source connected with the controller to receive power alternately from the first and second power sources.

24. The system of claim 23, wherein the first power source is 3V and the second power source is 1.5V.

25. The system of claim 23, further comprising an item selected from the group consisting of footwear, an article of clothing, and a personal accessory.

26. The system of claim 23, further comprising a third voltage source in series with the first voltage source, connected to at least one additional light source.

27. A method of making a flashing light system, the method comprising:

connecting an inertia switch to a controller, the controller further comprising a memory with at least two sequences for flashing the light sources;

connecting the controller to at least two light sources;

connecting a first power source to the controller and at least one of the light sources; and connecting a second power source to at least one of the light sources, wherein the controller is capable of alternately connecting the first power source and the second power source to at least one of the at least two light sources.

* * * * *